US007152757B2

(12) United States Patent
Huffer et al.

(10) Patent No.: US 7,152,757 B2
(45) Date of Patent: Dec. 26, 2006

(54) CAN AND BOTTLE DISPENSER

(75) Inventors: Doug Huffer, Aiken, SC (US); Fred Lowery, Urbandale, IA (US); Gary Petersen, Grinnell, IA (US); Keith Gausmann, Westerville, OH (US); Samuel Marino, Grove City, OH (US); Gary Myers, Westerville, OH (US); Jamison J. Float, Westerville, OH (US); Jay F. Perkins, Pickerington, OH (US); Steve Pever, Bellefontaine, OH (US); Robert Hayes, Lewis Center, OH (US); Michael T. Kopczewski, Grove City, OH (US); Paul E. Hsu, Powell, OH (US); Douglas G. Schaefer, Columbus, OH (US); Brent L. Burchfield, Dublin, OH (US); Jeffrey T. DeBord, Worthington, OH (US)

(73) Assignee: Maytag Corporation, Newton, IA (US)

( * ) Notice: Subject to any disclaimer, the term of this patent is extended or adjusted under 35 U.S.C. 154(b) by 46 days.

(21) Appl. No.: 10/891,870

(22) Filed: Jul. 14, 2004

(65) Prior Publication Data

US 2005/0167440 A1 Aug. 4, 2005

Related U.S. Application Data

(60) Provisional application No. 60/540,632, filed on Jan. 30, 2004, provisional application No. 60/487,468, filed on Jul. 14, 2003.

(51) Int. Cl.
*G07F 11/16* (2006.01)

(52) U.S. Cl. ..... 221/263; 221/133; 221/222; 221/277

(58) Field of Classification Search ..... 221/133, 221/167, 194, 196, 222, 263, 277, 115, 256, 221/266, 197
See application file for complete search history.

(56) References Cited

U.S. PATENT DOCUMENTS

| | | | | |
|---|---|---|---|---|
| 2,108,376 | A | 2/1938 | Copeland | |
| 2,711,241 | A * | 6/1955 | Abrahamsen | 193/38 |
| 2,915,162 | A | 12/1959 | Umstead | |
| 3,748,688 | A | 7/1973 | Berkowitz | |
| 3,831,806 | A | 8/1974 | Lindsey | |
| 3,832,754 | A | 9/1974 | Maertin et al. | |
| 3,869,753 | A | 3/1975 | Boback | |

(Continued)

FOREIGN PATENT DOCUMENTS

| | | |
|---|---|---|
| DE | 44 16 889 | 12/1995 |

(Continued)

*Primary Examiner*—Gene O. Crawford
*Assistant Examiner*—Timothy Waggoner
(74) *Attorney, Agent, or Firm*—Brian J. Laurenzo; Jason M. Hunt

(57) ABSTRACT

A coupling for connection of a tube comprises a coupling housing which includes a first end into which the tube is inserted, a clamping ring which is positioned in the coupling housing against a first conical surface, a sealing ring which is positioned in the coupling housing, and a return ring which is positioned in the coupling housing between the clamping ring and a second end of the housing adjacent a second conical surface that is tapered opposite to the first conical surface. The return ring is expandable and comprises a central aperture which is smaller than the external diameter of the tube. Accordingly, when the tube is pushed into the coupling housing and forced through the return ring, the return ring will expand and move along the second conical surface.

16 Claims, 31 Drawing Sheets

U.S. PATENT DOCUMENTS

| | | | | | |
|---|---|---|---|---|---|
| 3,894,622 | A | | 7/1975 | Dunn et al. | |
| 3,975,794 | A | | 8/1976 | Kaiser et al. | |
| 4,002,384 | A | | 1/1977 | Brown et al. | |
| 4,033,477 | A | | 7/1977 | Hoppe et al. | |
| 4,046,242 | A | | 9/1977 | Ahlstrom | |
| 4,194,612 | A | | 3/1980 | Ahlstrom | |
| 4,205,763 | A | | 6/1980 | Merl | |
| 4,228,903 | A | | 10/1980 | Eckert | |
| 4,245,755 | A | | 1/1981 | Craven et al. | |
| 4,334,338 | A | | 6/1982 | Conn | |
| 4,356,923 | A | | 11/1982 | Young et al. | |
| 4,416,363 | A | | 11/1983 | Stork | |
| 4,509,658 | A | * | 4/1985 | Oden | 221/115 |
| 4,629,090 | A | | 12/1986 | Harris et al. | |
| 4,639,875 | A | | 1/1987 | Abraham et al. | |
| 4,682,709 | A | | 7/1987 | Brandes et al. | |
| 4,763,963 | A | | 8/1988 | Lauffer et al. | |
| 4,998,628 | A | | 3/1991 | Ross | |
| D321,212 | S | * | 10/1991 | Unruh | D20/8 |
| 5,090,589 | A | | 2/1992 | Brandes et al. | |
| 5,178,299 | A | | 1/1993 | Mundt | |
| 5,193,901 | A | | 3/1993 | Stone | |
| 5,197,793 | A | | 3/1993 | Stone | |
| 5,462,198 | A | | 10/1995 | Schwimmer | |
| 5,544,024 | A | | 8/1996 | Wittern, Jr. et al. | |
| 5,547,105 | A | | 8/1996 | Oden et al. | |
| 5,570,587 | A | | 11/1996 | Kim | |
| 5,613,620 | A | | 3/1997 | Center et al. | |
| 5,638,985 | A | | 6/1997 | Fitzgerald et al. | |
| 5,722,526 | A | | 3/1998 | Sharrard | |
| 5,728,999 | A | | 3/1998 | Teicher | |
| 5,821,511 | A | | 10/1998 | Williams et al. | |
| 5,848,726 | A | | 12/1998 | Yajima et al. | |
| 5,865,324 | A | | 2/1999 | Jay et al. | |
| 5,870,801 | A | | 2/1999 | Kim | |
| 5,884,366 | A | | 3/1999 | Jeong | |
| 5,924,595 | A | * | 7/1999 | Crook | 221/93 |
| 5,956,876 | A | | 9/1999 | Burdette et al. | |
| 5,960,518 | A | | 10/1999 | Jeong | |
| 5,971,204 | A | | 10/1999 | Apps | |
| 6,030,064 | A | | 2/2000 | Kim | |
| 6,128,807 | A | | 10/2000 | Lim et al. | |
| 6,206,237 | B1 | | 3/2001 | Dillon et al. | |
| 6,230,906 | B1 | | 5/2001 | Padiak et al. | |
| 6,250,452 | B1 | | 6/2001 | Partyka et al. | |
| 6,321,934 | B1 | | 11/2001 | Immel | |
| 6,330,958 | B1 | | 12/2001 | Ruskin et al. | |
| 6,360,140 | B1 | | 3/2002 | Vidondo | |
| 6,367,653 | B1 | | 4/2002 | Ruskin et al. | |
| 6,371,581 | B1 | | 4/2002 | Ring et al. | |
| 6,386,389 | B1 | | 5/2002 | Percy et al. | |
| 6,415,953 | B1 | * | 7/2002 | O'Brien et al. | 221/196 |
| 6,539,282 | B1 | | 3/2003 | Metcalf et al. | |
| 6,628,764 | B1 | | 9/2003 | Petite | |
| 2003/0057266 | A1 | | 3/2003 | Long | |
| 2003/0164377 | A1 | | 9/2003 | Budz et al. | |
| 2004/0007546 | A1 | | 1/2004 | Stinnett et al. | |

FOREIGN PATENT DOCUMENTS

| | | |
|---|---|---|
| JP | 1-253084 | 10/1989 |
| JP | 1-306987 | 12/1989 |
| JP | 2-40788 | 2/1990 |
| JP | 2-259988 | 10/1990 |
| JP | 4-102189 | 4/1992 |
| JP | 4-267496 | 9/1992 |
| JP | 5-2683 | 1/1993 |
| JP | 5-54245 | 3/1993 |
| JP | 5-159146 | 6/1993 |
| JP | 11-105807 | 4/1998 |
| JP | 11-16033 | 1/1999 |
| JP | 11-250327 | 9/1999 |
| JP | 2000-82167 | 3/2000 |
| JP | 2001-221677 | 8/2001 |
| JP | 2003-187308 | 7/2003 |
| WO | WO 91/01536 | 2/1991 |

* cited by examiner

CAN AND BOTTLE DISPENSER

This application claims the benefit of related U.S. Provisional Application Ser. No. 60/487,468, filed on Jul. 14, 2003 and U.S. Provisional Application Ser. No. 60/540,632, filed on Jan. 30, 2004, which applications are hereby incorporated by reference.

FIELD OF INVENTION

The present invention generally involves the field of can and bottle dispensers, and more particularly involves a vending-machine-like dispenser for dispensing bottles and cans that is suitable for use in a home or office.

BACKGROUND

Many homes and offices have refrigerators that are dedicated primarily or exclusively to holding bottles and cans of beverages. In some instances the appearance of these refrigerators is not pleasing. In many regards, the appearance and functionality of a vending machine would be preferable to a standard refrigerator. In particular, it would be desirable for the beverage refrigerators to be able to selectively dispense a single can or bottle without opening the refrigerated portion. However, known vending machines have several drawbacks that them make ill-suited for in-home, or other noncommercial use. The vending machines have security and payment features that are unnecessary and cumbersome in many instances.

What is needed in the art is vending-machine-like dispenser that combines the advantages of a vending machine and a dedicated beverage refrigerator, while eliminating many of the disadvantages of both.

SUMMARY OF INVENTION

According to one embodiment the present invention is directed to a dispenser for dispensing bottles and cans. The dispenser includes an enclosed storage area and an accessible dispensing area. The dispenser includes a plurality of storage bins in the storage area, each of the storage bins being suitable for storing bottles and cans without any necessary structure to permit adjustment to distinguish between bottles and cans. A dispensing mechanism is provided to selectively dispense a single can or bottle from a desired bin to the dispensing area upon receipt of a selection signal. The dispensing mechanism may be a rotating-cup type dispenser. The storage bins may be modular trays that stack upon each other. A friction material may be used to slow the bottles and cans as they are dispensed from the stacked modular trays to the dispensing area down a generally vertical dispensing path. Biased flaps may extend into the generally vertical dispensing path to further slow the bottles and cans as they are dispensed down the dispensing path.

According to another embodiment of the present invention, the invention comprises a dispenser for in-home use that has the appearance of a commercial vending machine. The dispenser does not include structure for receiving payment. The dispenser will dispense both bottles and cans without adjustment to the dispenser when loading the bottles and cans into the dispenser.

According to yet another embodiment of the present invention, the invention comprises a dispenser having a storage cabinet. A plurality of storage bins are provided within the storage cabinet. The storage bins are stacked upon each other. A dispensing mechanism is provided for selectively moving a product from one of the storage bins to a vertical dispensing path in response to a selection signal. The selected product falls down the vertical dispensing path to a dispensing region. A slowing mechanism is provided to slow the rate at which the product falls through the dispensing path. The slowing mechanism may be a friction fabric, optionally a fabric net. The slowing mechanism may also include resiliently biased flaps that extend into the dispensing path.

According to another embodiment of the present invention a dispenser includes a top surface that is convexly curved in order to discourage the placement of heavy objects on the top surface. The dispenser may be a refrigerated unit that is raised above a support surface by a stand. The dispenser top surface may further include a flat level portion suitable for supporting dispensed products.

According to another feature of the present invention a dispenser has a hinge that facilitates the installation and removal of a door from a cabinet. The hinge includes a male portion and a female portion for mated engagement with the male portion. One of the portions of the hinge is attached to the door and the other portion is attached to cabinet such that the male and female portions can be taken out of mated engagement by lifting the door until the male portion is clear from the female portion. A tab is attached to the door. A catch is attached to the cabinet such that the catch interferes with the tab to prevent lifting the door if the door is closed, but permits lifting the door if the door is opened a sufficient amount. A sufficient amount may be approximately ninety degrees. Preferably the hinge is strong enough that the dispenser can be lifted using the door when the door is closed without the door being separated from the cabinet.

According to another embodiment of the present invention a dispensing machine has selection buttons with flavor indicating cards. The dispensing machine includes a front portion with a plurality of selection buttons. A hinge portion is included on each of the seelction buttons. The selection buttons are rotatable about the hinge between an open and closed position. Each selection button includes a flavor card holding portion for retaining a flavor card, the flavor card holding portion being accessible when the button is in an open position. The selection button is movable from the closed position to the open position without the need for tools, and without the need to open the dispensing machine.

According to another embodiment of the present invention a dispenser for dispensing bottles and cans includes a storage bin for storing bottles and cans prior to being dispensed. A dispensing mechanism is provided for sequentially dispensing the bottles and cans one at a time from the storage bin without the need to make any adjustments to the dispensing mechanism or the storage bin. The storage bins may include a sloped bottom surface that tilts towards a first end where a rotating-cup type dispenser is provided, the tilt of the bottom surface allowing gravity to urge bottles or cans stored in the storage bin towards the dispensing mechanism.

According to another embodiment of the present invention a dispenser for dispensing bottles and cans includes an enclosed cabinet. A plurality of storage bins are provided within the enclosed cabinet. Wherein the plurality of storage bins includes a bottom storage bin and at least one additional storage bin stacked on top of the bottom storage bin. Each of the storage bins has a bottom surface on which cans and bottles can rest. The bottom surfaces are generally horizontal, but have a sufficient slope that gravity tends to urge bottles and cans towards the lower end of the sloped surface. Each storage bin has a rotating cup dispenser proximate to the lower end of the bottom surface. A mechanism is provided for selectively activating a desired rotating cup dispenser to dispense a single can or bottle from one of the storage bins.

According to another embodiment of the present invention a dispenser for dispensing cylindrical containers includes a storage bin for storing cylindrical containers. A sensor is provided for sensing when there is less than a specified number of cylindrical containers remaining in the storage bin, and wherein that specified number is greater than one. An indicator is provided to provide an indication when the sensor senses that there are less than the specified number of cylindrical containers remaining in the storage bin. The storage bin may include a bottom surface that is tilted sufficiently towards a first end of the storage bin that the cylindrical containers are urged towards the first end by gravity when the cylindrical containers are placed on the bottom surface with their axes transverse to the tilt. The storage bin also includes a rear wall. The bottom surface also being tilted towards the rear wall such that the cylindrical containers are urged towards the rear wall when the sensor is located on the rear wall to sense contact between the cylindrical containers and the rear wall.

According to another embodiment of the present invention a dispenser prevents the dispensing of a second item until a first item has moved completely into a dispensing area. The dispenser includes a cabinet having an enclosed area containing items to be dispensed. An accessible dispensing are is provided. A dispensing mechanism is provided to move the items to be dispensed from the enclosed area to the dispensing area. A barrier is provided between the dispensing area and the enclosed area. The barrier is biased to a closed position that substantially covers an opening between the dispensing area and the enclosed area. The barrier is movable to an open position by a weight of a dispensed item pressing against the barrier. A sensor is provided to sense when the barrier has moved to an open position and for preventing a second selected from being dispensed until the barrier has returned to a closed position.

According to another embodiment of the present invention a dispenser has an illuminated dispensing area that is illuminated for a short period of time after an item is dispensed. The dispenser includes a cabinet containing items to be dispensed in an enclosed area. A dispensing area is located externally to the cabinet. A light source is provided to at least partially illuminate the dispensing area. A barrier is provided between the enclosed area and the dispensing area. The barrier is biased towards a normally closed position. The barrier is movable to an open position by the weight of a selected item moving from the enclosed area to the dispensing area. A sensor is provided for sensing when the barrier has moved from the open position to the closed position. A mechanism is provided for illuminating the dispensing area for a specified period of time after the barrier has moved from the open position to the closed position.

According to another embodiment of the present invention a dispenser has a lock-out feature. The dispenser includes a cabinet containing a plurality of storage units for storing items to be dispensed within an interior area of the cabinet. A corresponding switch is associated with each storage unit and each switch is adjustable between an allowed position and a disabled position. A selection mechanism is provided external to the cabinet for selecting a storage unit from which to dispense a desired item. A dispensing mechanism is provided for dispensing a desired item from a selected storage unit to a dispensing area external to the interior area of the cabinet when the switch corresponding to the selected storage bin is in the allowed position and for not dispensing the desired item when the switch corresponding to the selected storage bin in an the disabled position. An opening provides access to the interior area of the cabinet. A barrier is provided to open and close the opening. A locking mechanism is provided on the barrier to prevent access to the switches when the locking mechanism is locked and to allow access to the switches when the locking mechanism is unlocked.

BRIEF DESCRIPTION OF THE DRAWINGS

The detailed description will refer to the following drawings, wherein.

DETAILED DESCRIPTION OF PREFERRED EMBODIMENTS

Figure 1:
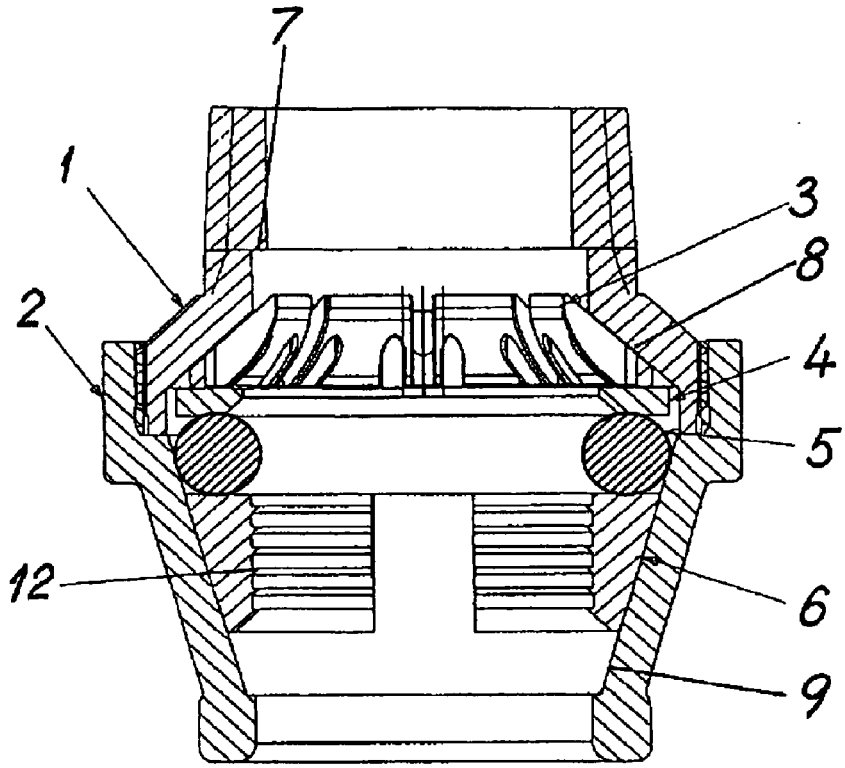
FIG. 1 is an isometric view of one embodiment of a dispenser and stand according to the present invention.

Shown generally in the drawings and described below are various embodiments of a dispenser 10. The preferred use of the dispenser 10 is as a personal beverage dispenser in a home or office. It has several preferred features. Notably the dispenser 10 need not be provided with a coin or other money receptacle, and it is intended to vend items without the insertion of any money, or other payment. Many of the features of the dispenser 10 would be well suited for use in traditional for-money vending machines. The dispenser 10 is designed to be able to dispense both cans and bottles without changing the configuration, or adding additional parts. As seen in the figures, the vending unit may be used free-standing, or may be placed on a matching stand 12. Preferably, the unit will include accommodations for attaching a removable display or sign, such as a logo for a team, race car driver, or other decoration.

Figure 2:
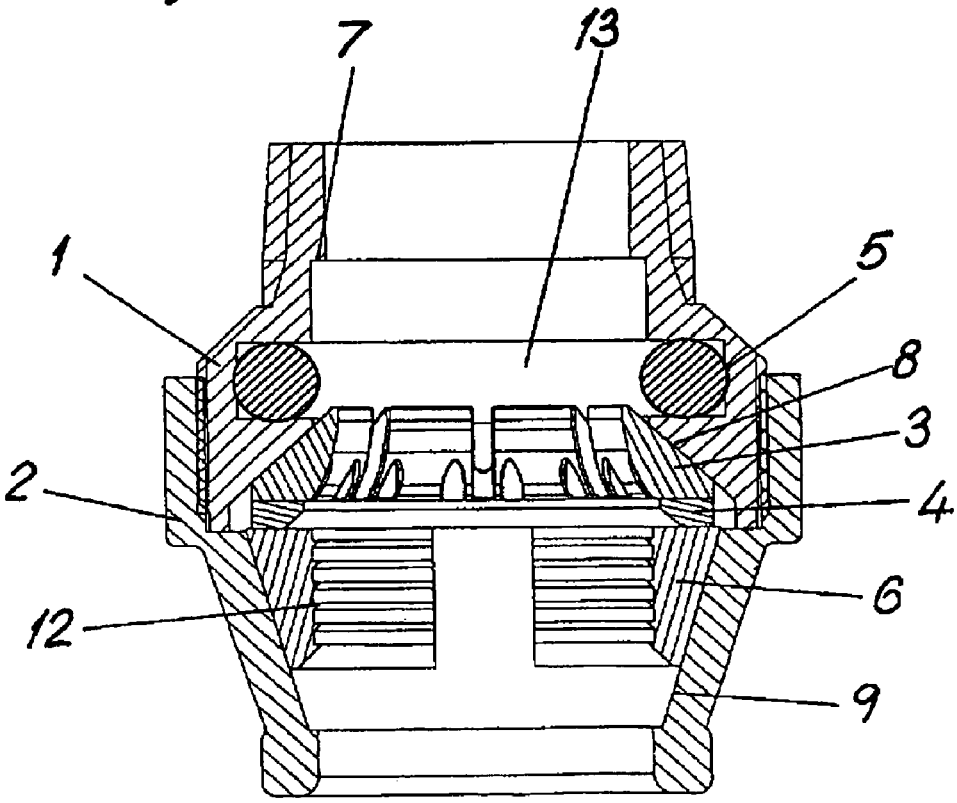
FIG. 2 is an isometric view of an embodiment of a dispenser according to the present invention.

FIG. 1 shows an embodiment of a dispenser 10 according to the present invention. If desired, the dispenser 10 may be mounted on top of a stand 12 or pedestal as shown in FIG. 1. Alternatively, the dispenser 10 may be used as a tabletop model without the pedestal as shown in FIG. 2. The dispenser 10 preferably includes a refrigerated cabinet 14 for storing beverage containers. The refrigerated cabinet 14 may be provided with any suitable refrigeration equipment (not shown) in order to keep a storage area of the cabinet 14 properly chilled. Those of skill in the art will be well aware of refrigeration units that will work for the purpose. Preferably the refrigeration unit will be electric powered and will be supplied with a cord and plug 16 to fit a standard electrical outlet. The dispenser 10, or pedestal 12, should be placed on a flat, level surface in order to work properly.

The dispenser 10 is provided with a plurality of selection buttons 18 on its front face 20. In the embodiment of FIG. 1, the front face 20 is part of a door 22 that is hingedly attached to the cabinet 14. In order to have a beverage container dispensed, a user would push one of the selection buttons 18. Preferably the selection buttons 18 are marked with an indicia of the type of beverage that will be dispensed. Each selection button 18 corresponds to a storage bin 24 (not visible in FIG. 1) inside the cabinet 14. In the embodiment shown in FIG. 1, there are four selection buttons 18; however fewer or more selection buttons 18 could be provided depending on the number of storage bins within the particular dispenser 10. After a selection is made by pressing one of the selection buttons 18, a beverage container, or other item to be dispensed (not shown in FIG. 1), will be dispensed from a storage bin 24 corresponding to that selection button 18. The beverage container will be dispensed to a dispensing area 28 at the front center of the door 22. The dispensing area 28 should be provided with a lip 30, or some other barrier, for retaining the beverage container 26 in the dispensing area 28 until a user removes the container 26.

The dispenser 10 and stand 12 may be provided with design features such as grooves and ridges, and other features that form a visual image. For example, in the dispenser 10 and stand 12 of FIG. 1, a pair interlocking arches are formed by various design features. A first hanging arch 32 is formed by a depression on the front of the dispenser 10. A second interlocking arch 34 is formed by a depression on the front of the stand 12 and a top line of the dispensing area 28. The retaining lip 30 of the dispensing area is shaped similarly to the apex of the arches 32 and 34 in order to echo this design element.

As seen in FIG. 1, indicator lights 36 may be provided on the front of the dispenser 10 to provide information regarding the status of the dispenser 10. For example, one indicator light 36 may be provided corresponding to each storage bin 24 in the cabinet 14. When the supply of beverage containers 26 in a given storage bin 24 is running low or empty, the light 36 adjacent to the selection button 18 corresponding to that bin 24 may be illuminated. If there a jam or other error within the dispenser 10, all of the lights 36 may flash to alert the user that the dispenser door 22 should be opened in order to investigate and resolve the problem. It may be possible to color code the lights 36 to provide additional information, i.e., yellow light means that the supply is running low, red light means it is completely empty. Additional information regarding use of the indicator lights 36 to signal a low product supply is provided below.

Figure 3A:
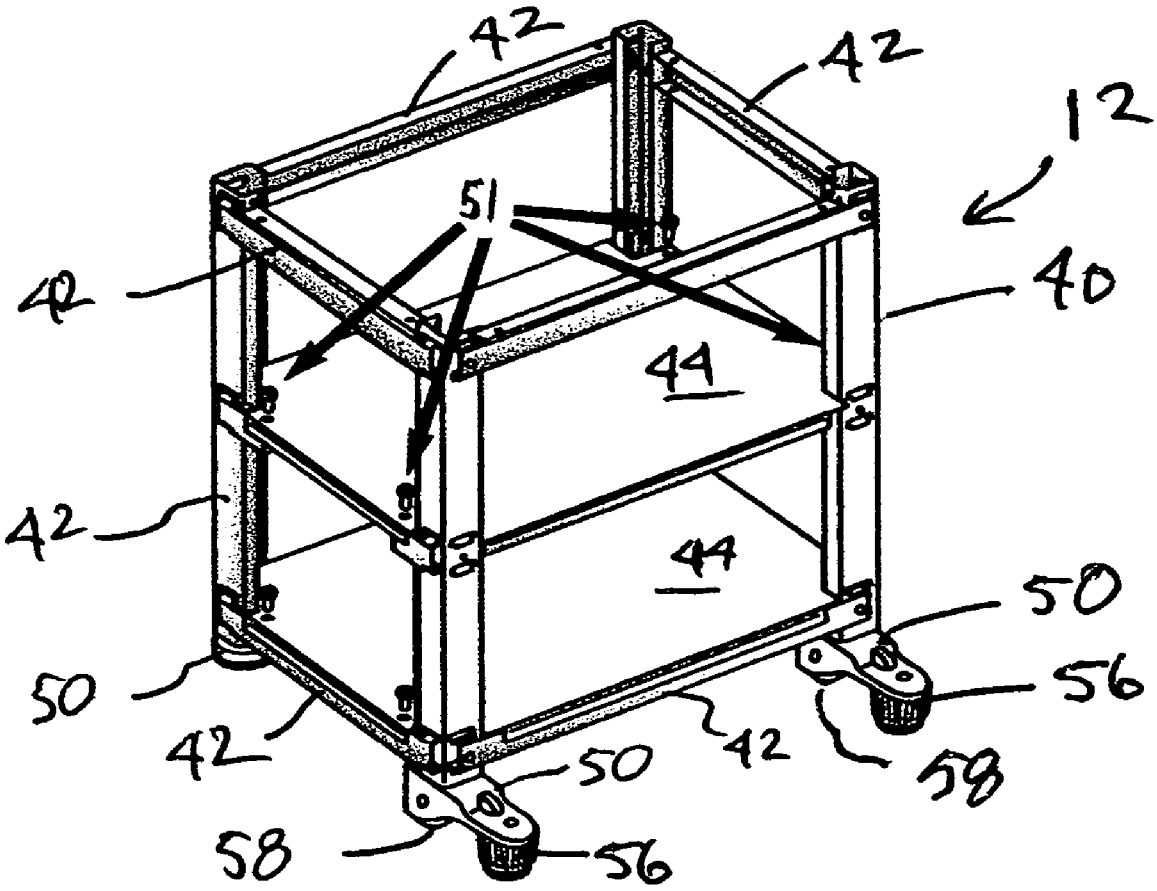
FIGS. 3*a, b*, and *c* are additional perspective views of the components that form a stand.
Figure 3B:
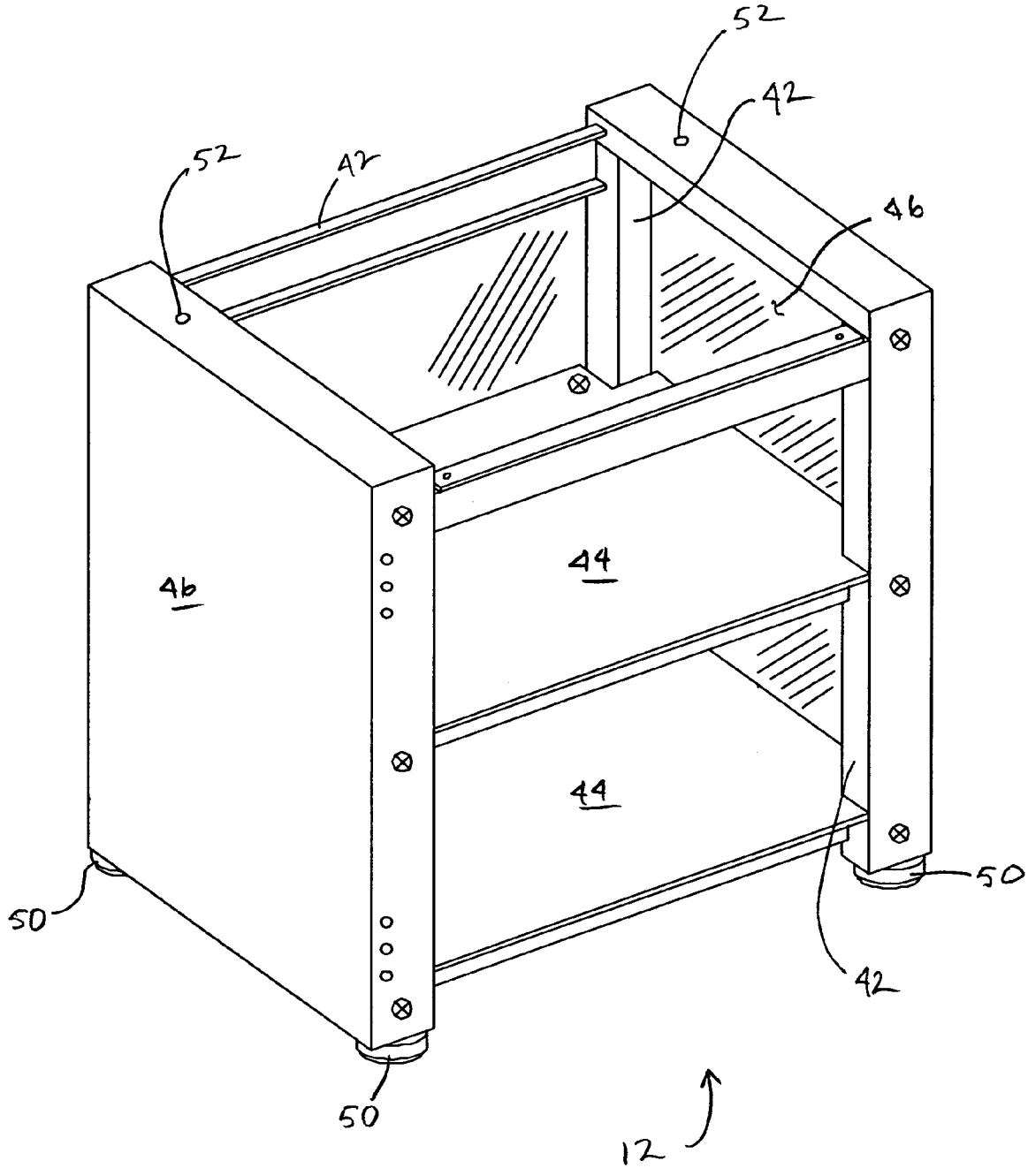
Figure 3C:
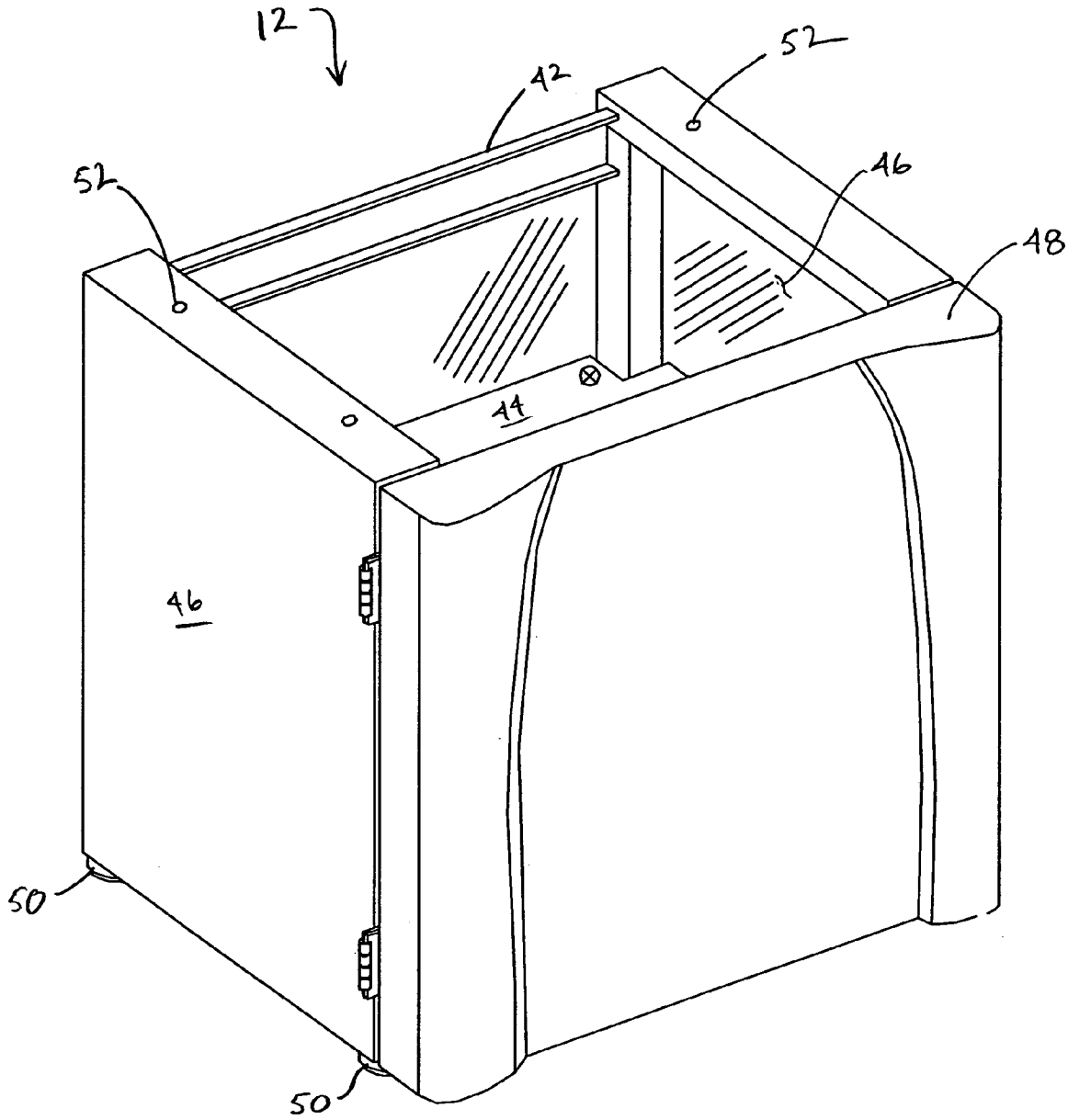

The stand 12, or pedestal, on which the dispenser 10 sits can be configured as a storage unit. The construction of a preferred stand 12, that includes a storage space 38, is shown in FIGS. 3*a*, 3*b* and 3*c*. The stand may be formed out of any suitably hard and rigid material. Preferably the stand 12 will be made to match the appearance of the exterior of the dispenser 10. Optionally, the stand 12 could also be provided with accommodations for display panels (not shown). The preferred stand 12 has an underlying frame 40 formed from elongated, interlocking rails 42. The rails 42 may support shelves 44, which may be fastened to the rails by fasteners 51. The exterior walls 46 are attached to the frame 40. Preferably the front of the stand is a door 48 that is hingedly attached to the front of the frame 40 or one of the side walls 46. The stand 12 may be provided with feet 50 that attach to the bottom of the stand 12. The feet 50 are preferably connected to threaded members such that they can be screwed into and out of the bottom of the stand 12 to extend at various lengths. In this manner, they can be used to level the stand 12 and dispenser 10. FIG. 3*a* illustrates an alternative embodiment of the feet 50. According to this embodiment the feet 50 at the front of the frame 40 comprise an adjustable leveling head 56 and a roller 58. The leveling head 56 can be adjusted up and down by rotating it. To support the stand 12 and dispenser 10, the leveling head 56 should be set so that the roller 58 is held slightly off the support surface. The rollers 58 can be used to move the stand 12 and dispenser 10 by raising the leveling heads 56 off the support surface by rotating the leveling heads to a raised position to leave the rollers 58 in contact with the support surface.

Figure 4:
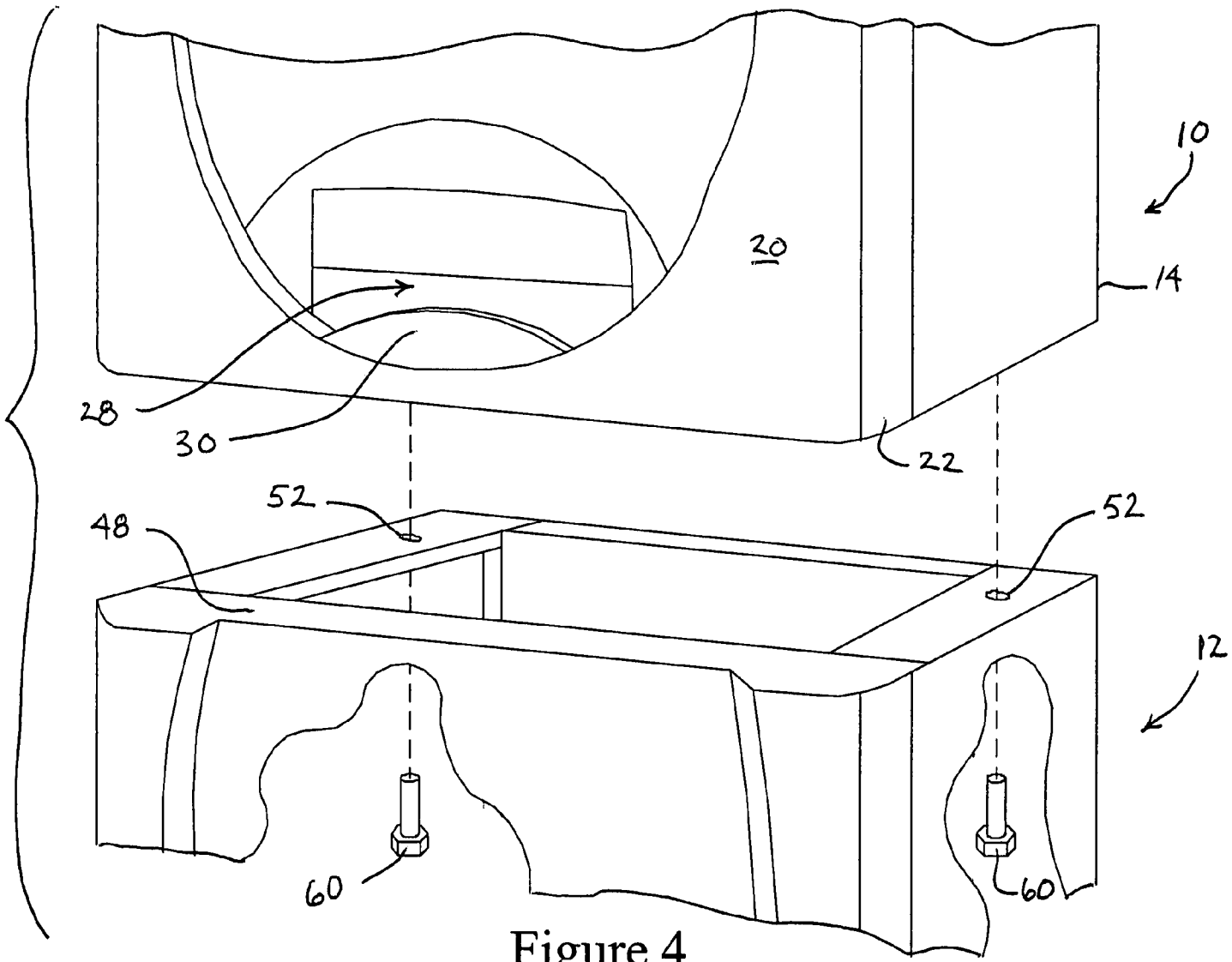
FIG. 4 is a partial perspective view of a dispenser and stand illustrating how they can be connected.

As shown in FIG. 4 it is desirable to secure the dispenser 10 to the stand 12, if a stand 12 is used. In the embodiment of FIG. 4, bolts 60 are fit though holes 52 in the top of the stand 12 and engage threaded openings (not shown) in the bottom of the cabinet 14. Those of skill in the art will be aware of alternative arrangements for securing the dispenser 10 to the stand 12.

Display panels 54 may be used with the dispenser 10. These display panels 54 may include any decorative design. Preferably the display panels 54 include logos or designs that relate to the user's favorite sports team or sports figure. For example, the display panels 54 could include logos and scenes of a team from the National Football League, a racecar driver, or a particular sports related motif. The display panels 54 preferably are easily changeable so that a user can change the appearance of the dispenser 10 by changing panels 54. A user might have several sets of display panels 54 that can be interchanged depending on the season or the mood of the user. In the embodiment shown in FIG. 1, a display panel 54 is provided on the front face 20 of the dispenser 10 and on each side of the dispenser 10. Optionally, as described in more detail below, the display panels 54 may be translucent, and the dispenser 10 may be provided with backlighting to illuminate one or more of the display panels 54.

Figure 5:
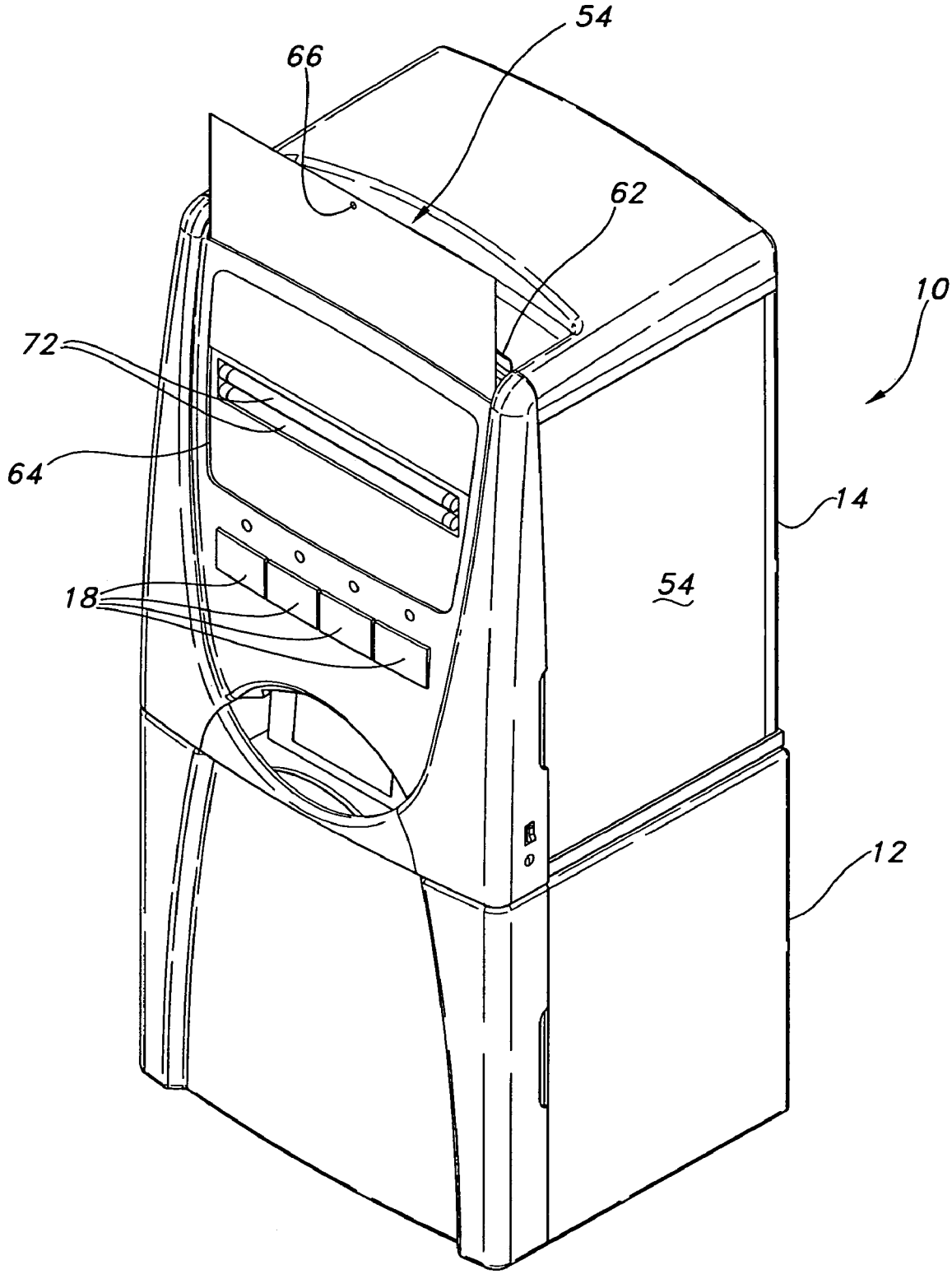
FIG. 5 is a perspective view of the front of a dispenser according to one embodiment of the present invention showing a removable graphics panel.
Figure 6:
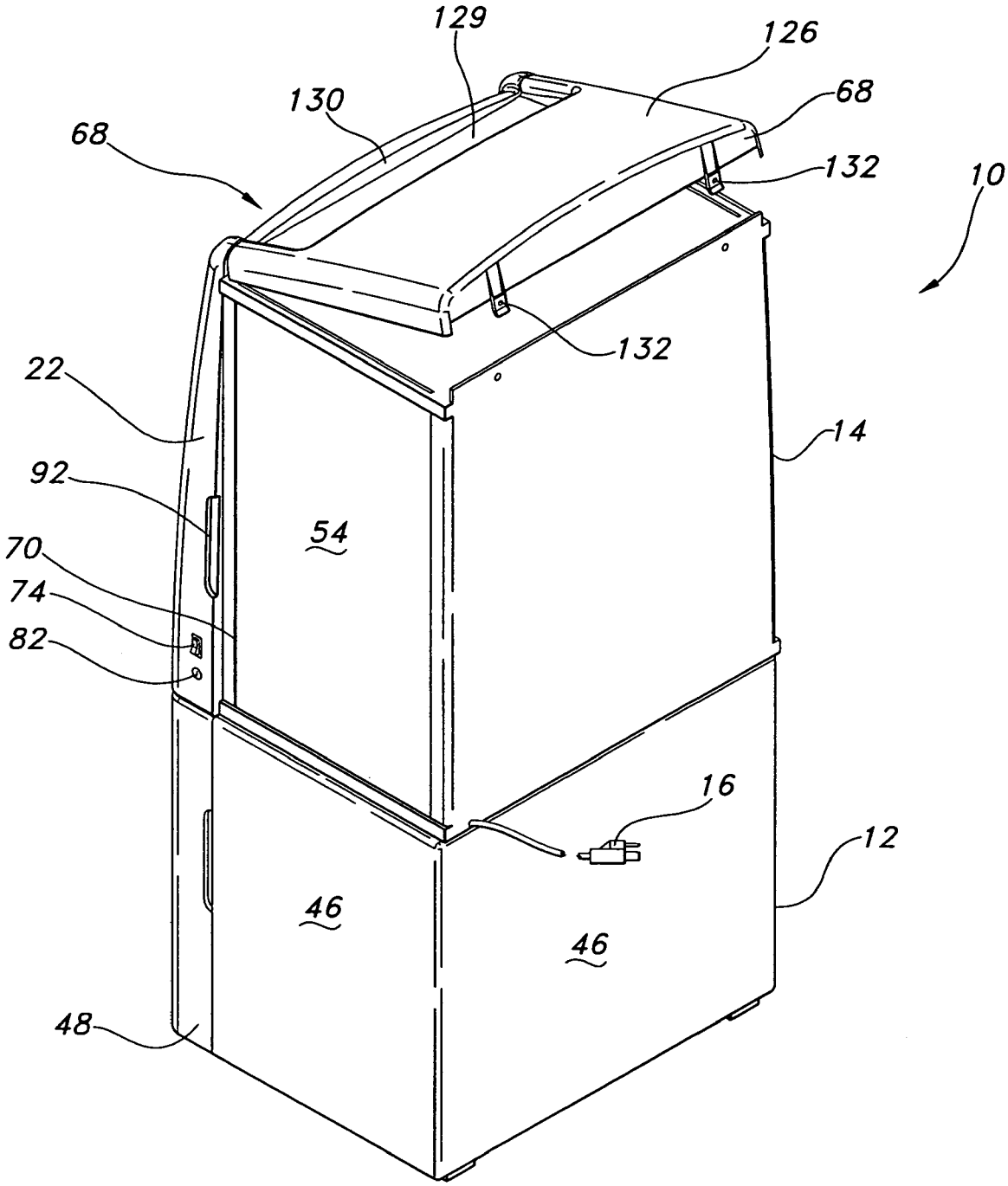
FIG. 6 is a rear perspective view of an embodiment of the present invention illustrating a removable top.
Figure 7:
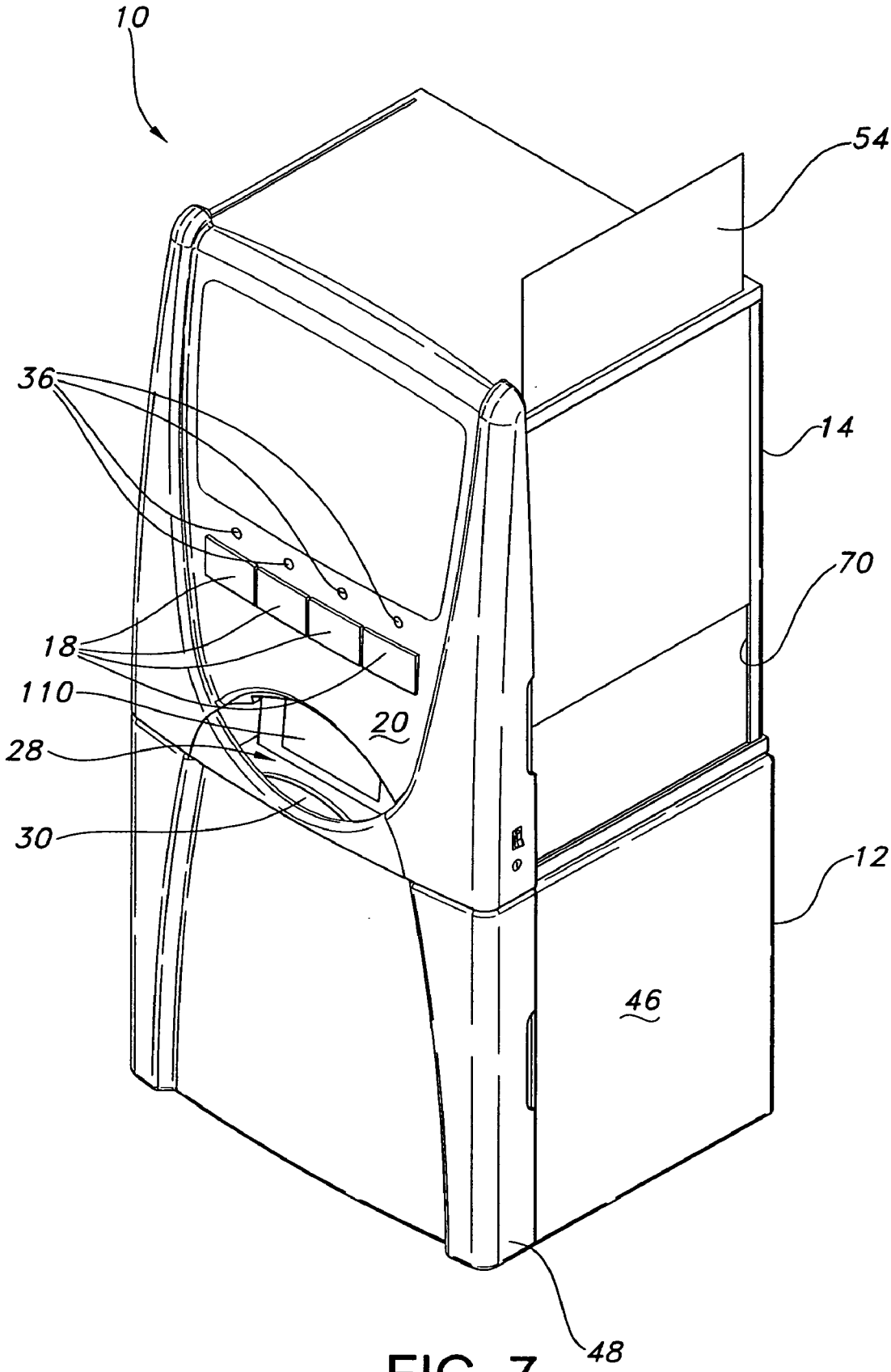
FIG. 7 is a partial perspective view of an embodiment illustrating the installation of a side graphics panel after removal of the removable top.
Figure 13:
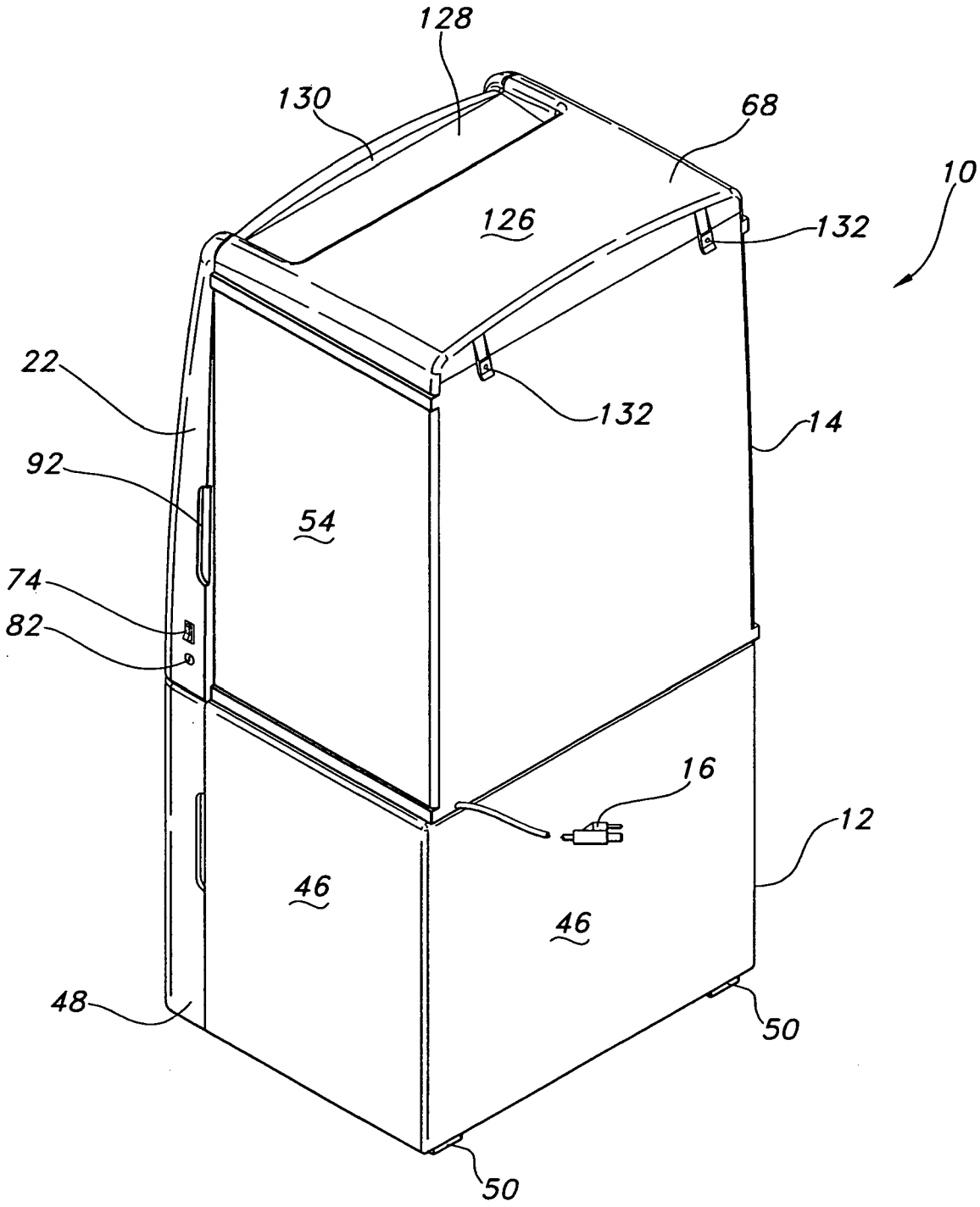
FIG. 13 is a partial perspective view from a generally rearward vantage point of the dispenser of FIG. 6 with the removable top piece mounted to the cabinet.

FIGS. 5–7 illustrate an embodiment that permits the display panels 54 to be easily installed. As seen in FIG. 5, in order to install a front panel 54, an access cover 62 is flipped back to reveal the front panel slots 64. The front display panel 54 may then be inserted into the front slots 64. A screw, or similar fastener, may be provided to fasten the display panel 54 securely in place by engaging hole 66 near the top of the front display panel 54. A similar process is shown in FIGS. 6 and 7 for the side display panels. In order to install the side display panels 54, the top 68 of the dispenser 10 is removed (FIG. 6), revealing the side panel slots 70. The side display panels 54 may then be inserted into the side slots 70 (FIG. 7). The top 68 can then be reattached (FIG. 13).

The embodiment shown in FIG. 5 includes light fixtures 72 to provide backlighting for the front display panel 54. This is especially effective when the front panel 54 is translucent, and gives dispenser 10 a vending-machine like appearance. As seen in FIG. 5, the preferred light fixtures 72 are fluorescent lights. Optionally the door 22 may be configured such that the fluorescent lights 72 also illuminate the selection buttons 18. An on/off switch 74 may be provided on the side of the door 22 (see FIG. 9) in order to selectively turn the backlighting on and off and to conserve energy by not having the unit constantly lit. Power is supplied to the light fixtures 72 by the power cord 16.

Figure 11:
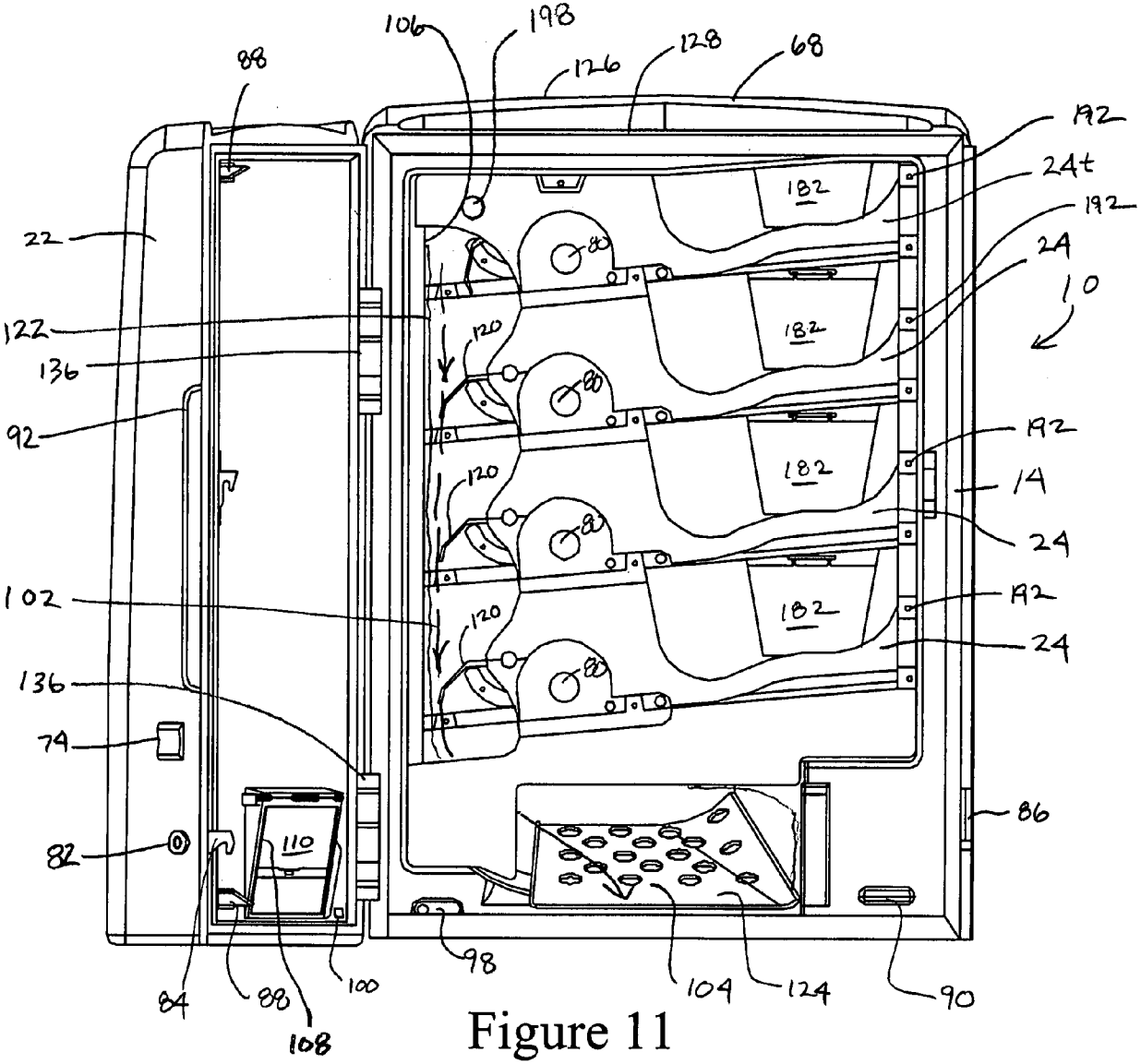
FIG. 11 is a front view of an embodiment of a dispenser according to the present invention with its door open slightly more than 90 degrees.
Figure 20A:
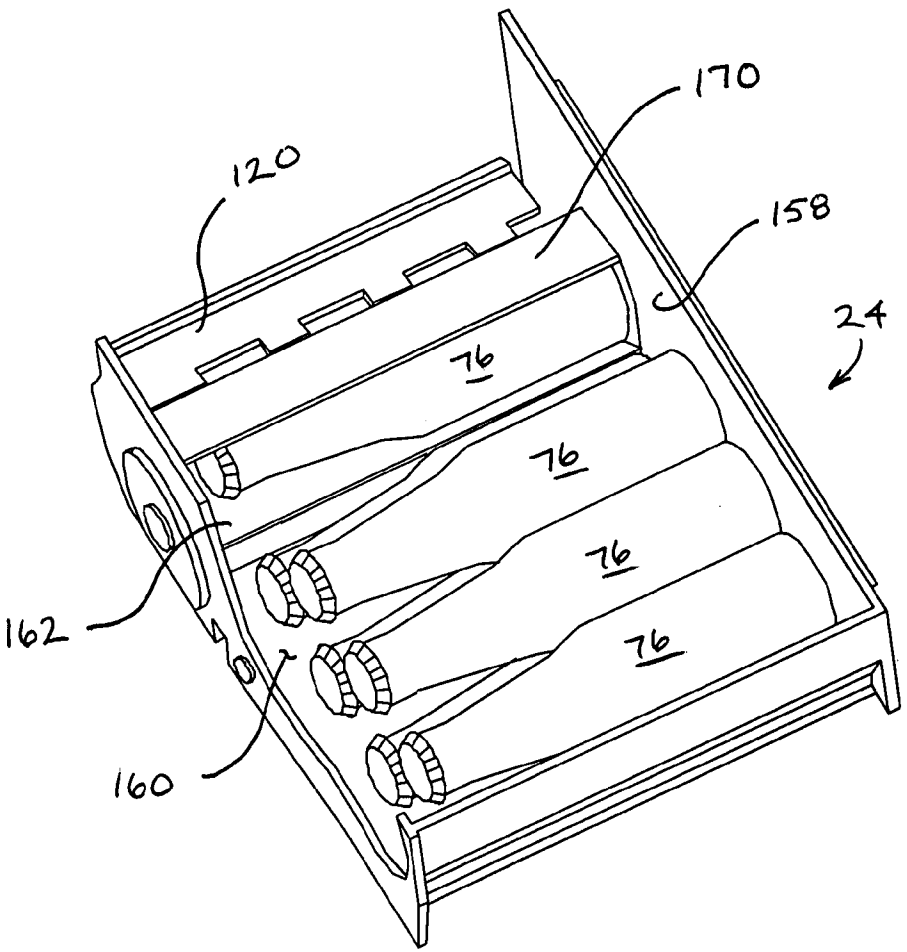
FIGS. 20*a* and *b* are perspective views showing how cans and bottles can be arranged in storage bins.
Figure 20B:
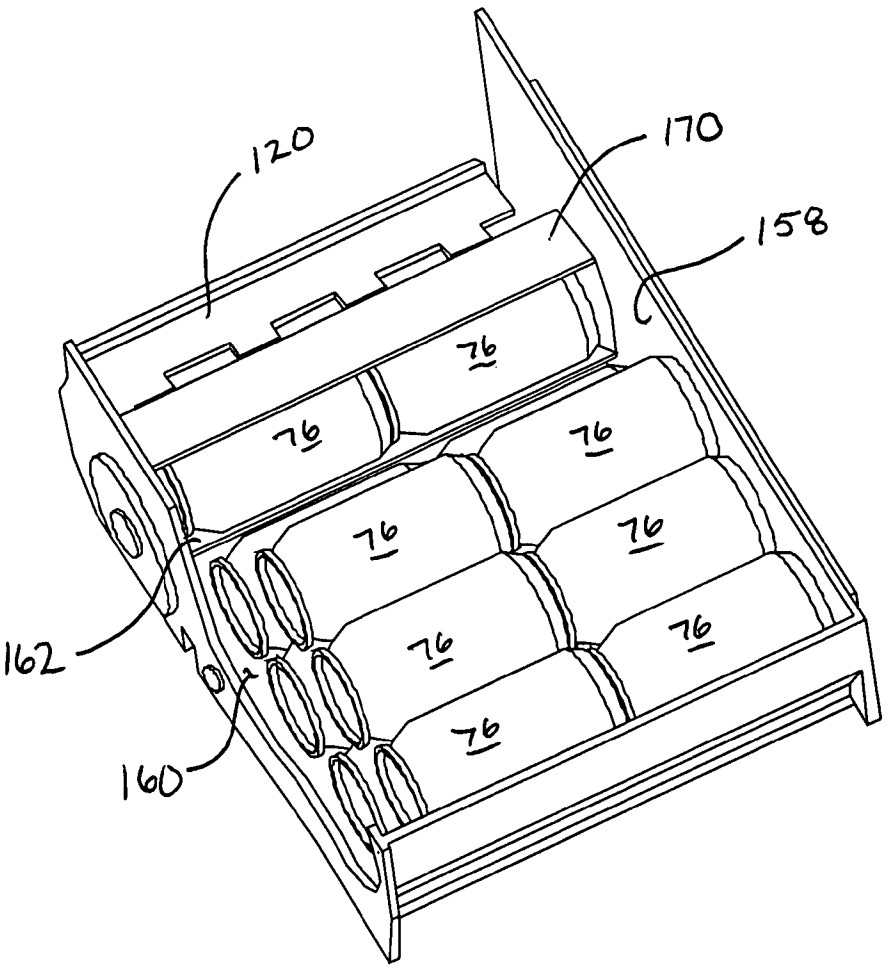
Figure 21:
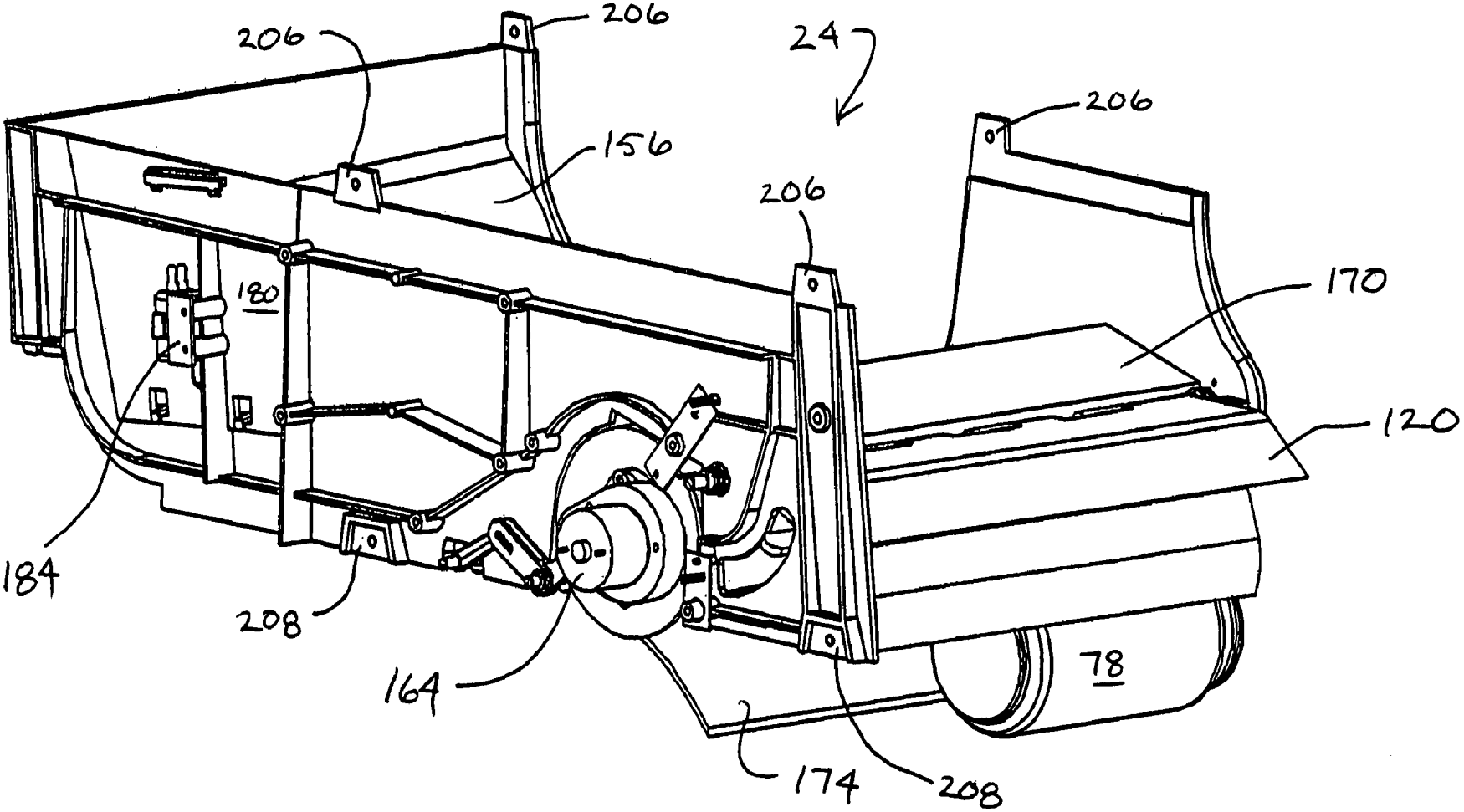
FIG. 21 is a perspective view, generally from the rear, of an embodiment of a storage bin with a can being dispensed.
Figure 22:
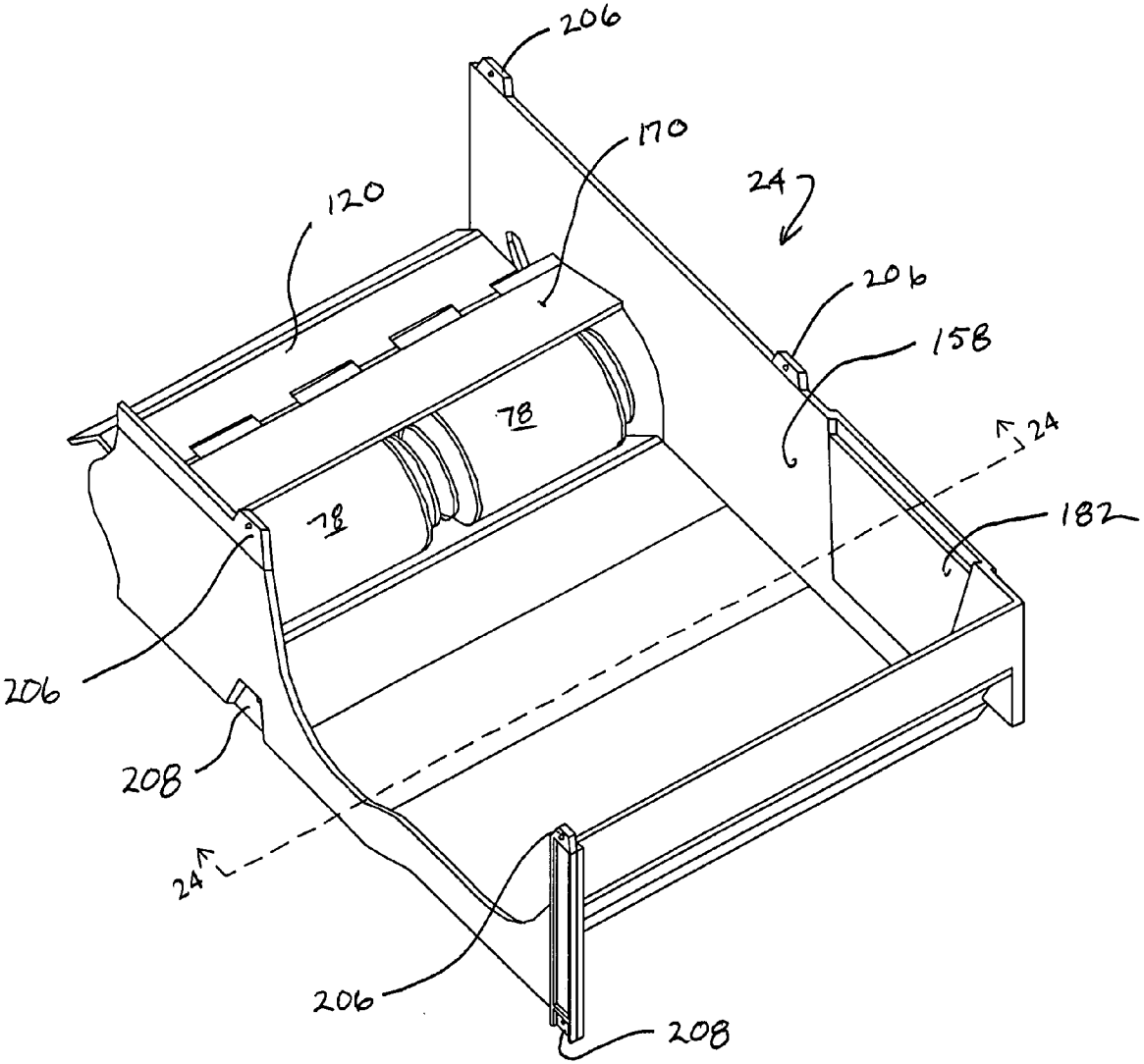
FIG. 22 is a perspective view of an embodiment of a storage bin according to the present invention with two cans in the dispensing cup.

FIG. 11 shows a front view of an embodiment of a dispenser 10 according to the present invention with its door 22 open greater than ninety degrees, exposing the interior of the refrigerated cabinet 14. In the embodiment of FIG. 11, four storage bins 24 are provided. The storage bins 24 stack on top of each other. The bottom three storage bins 24 are identical modular trays. The top storage bin 24*t* is similar to the lower three, but is shorter in height, in order to conserve space. The bottles 76 and cans 78 (not shown in FIG. 11) that will be dispensed lie on their sides in the storage bins 24, with their axes being generally perpendicular to front of the cabinet 14. The storage bins 24 tilt towards the left sidewall of the cabinet 14 of FIG. 11. The bottles 76 and cans 78 are thus urged by gravity to roll towards the dispensing mechanisms 80 provided on the left end of the storage bins 24 by the tilt of the storage bins 24 and the orientation of their axes. Preferably, cans 78 are loaded two-deep into the storage bins 24, and bottles 76 are loaded one-deep, as shown in FIGS. 20*a* and 20*b*.

With further reference to FIG. 11, the door 22 of the dispenser 10 may be provided with a keyhole 82 and latch 84. A key will fit into the keyhole 82 and selectively move the latch 84 between a locked position and an unlocked position. When the door 22 is shut, the latch 84 aligns with a catch 86 provided in the side of the cabinet 14. If the latch 84 is moved to the locked position when the door 22 is shut, the latch 84 engages the catch 86, and prevents the door 22 from being opened until the key is used to move the latch 84 back to the retracted unlocked position. Guides 88 may be provided on the door 22 to engage with slots 90 on the cabinet 14 to ensure proper alignment of the door 22 on the cabinet 14. The door 22 may be provided with a grip 92 in the form of a groove formed on the inside edge of the door 22. A thermostat 198, shown in the upper left corner of the cabinet in FIG. 11, may be provided to control the refrigeration equipment (typically a compressor) in order maintain the storage area at a desired cooling level.

Figure 28:
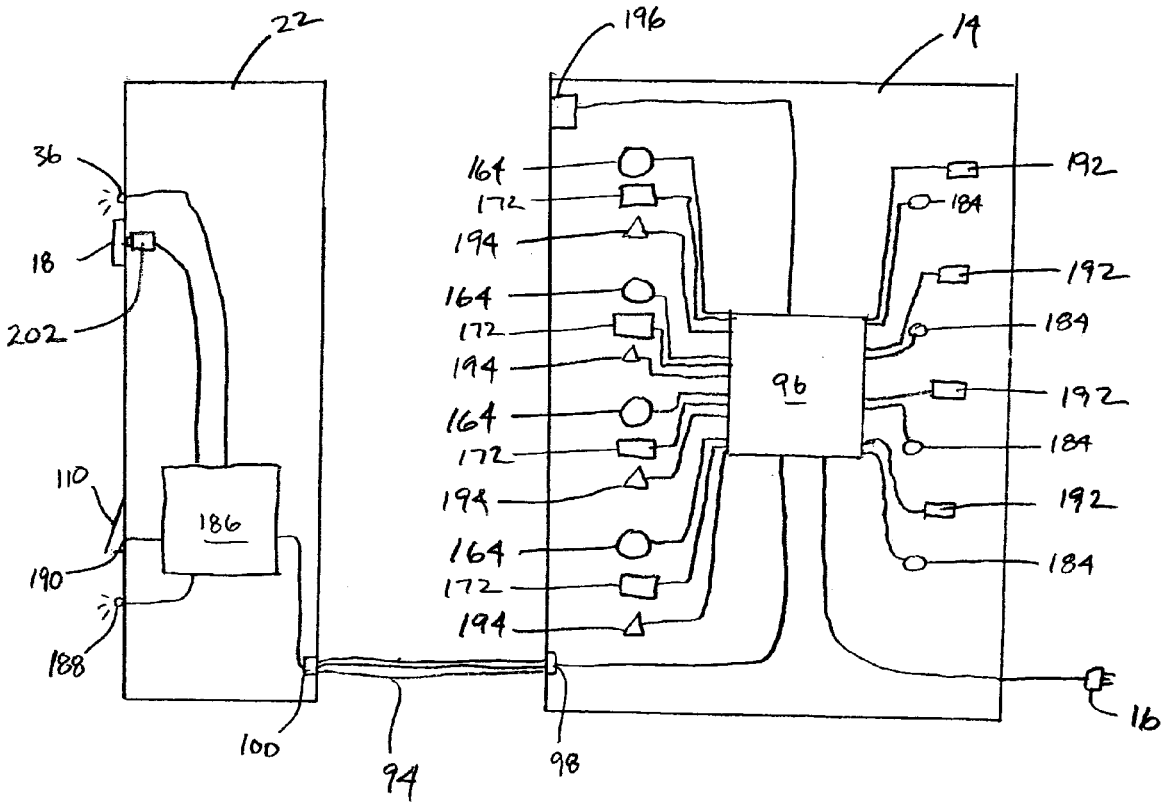
FIG. 28 is a graphic illustrating the electronic components of one embodiment of the present invention.

Electrical connection between the door 22 and the cabinet 14 is provided by a wire harness 94 (not shown in FIG. 11, see FIG. 28). The wire harness 94 is used to provide electrical connection between the light fixtures 72 and the power supply 16 and between a control unit 96 (not shown) in the cabinet 22 and the selection buttons 18 and indicator lights 36 on the door 22. The wire harness 94 connects between a cabinet wire harness receptacle 98 at the lower left of the cabinet 14 as seen in FIG. 11 and a corresponding door wire harness receptacle 100 on the inside of the door 22.

When a can 78 or bottle 76 is dispensed, it is moved from its storage bin 24 into a dispensing path 102 by the dispensing mechanism 80, which is described in more detail below. The bottle 76 or can 78 then drops straight down the dispensing path 102 shown in FIG. 11 between the left wall 106 of the dispenser 10 and the storage bins 24. At the bottom of the dispensing path 102 within the cabinet 14, a chute 104 guides the bottle 76 or can 78 through an opening 108 in the door 22 into the dispensing area 28. A dispensing area door 110 covers the opening 108 between the storage area and the dispensing area 28. The dispensing area door 110 is biased into a closed position, but is opened by the weight of a can 78 or bottle 76 as it drops down the chute 104. As will be explained in more detail, the dispensing area door 110 may be used as a trigger for signaling when a bottle 76 or can 78 has cleared the dispensing path 102, and for switching on a light in the dispensing area 28.

As will be explained in more detail below, spring biased flaps 120, netting 122, and padding 124 may be used to slow the speed at which the cans 78 and bottles 76 fall through the dispensing path 102, in order to reduce spewing or foaming that can occur when carbonated beverages are jarred before opening. The netting 122 is preferably a light fabric that will apply friction to the cans 78 and bottles 76 as they fall. The netting 122 may be attached to the left wall 106 of the cabinet 14, or any other place that appropriately places the netting 122 adjacent to, and slightly interfering with, the dispensing path 102. Hook and loop fasteners, such as those sold under the name Velcro® are preferred, but those of ordinary skill in the art will be aware of any number of ways of fastening the netting 122 so that it is provided adjacent to the dispensing path 102.

Figure 8:
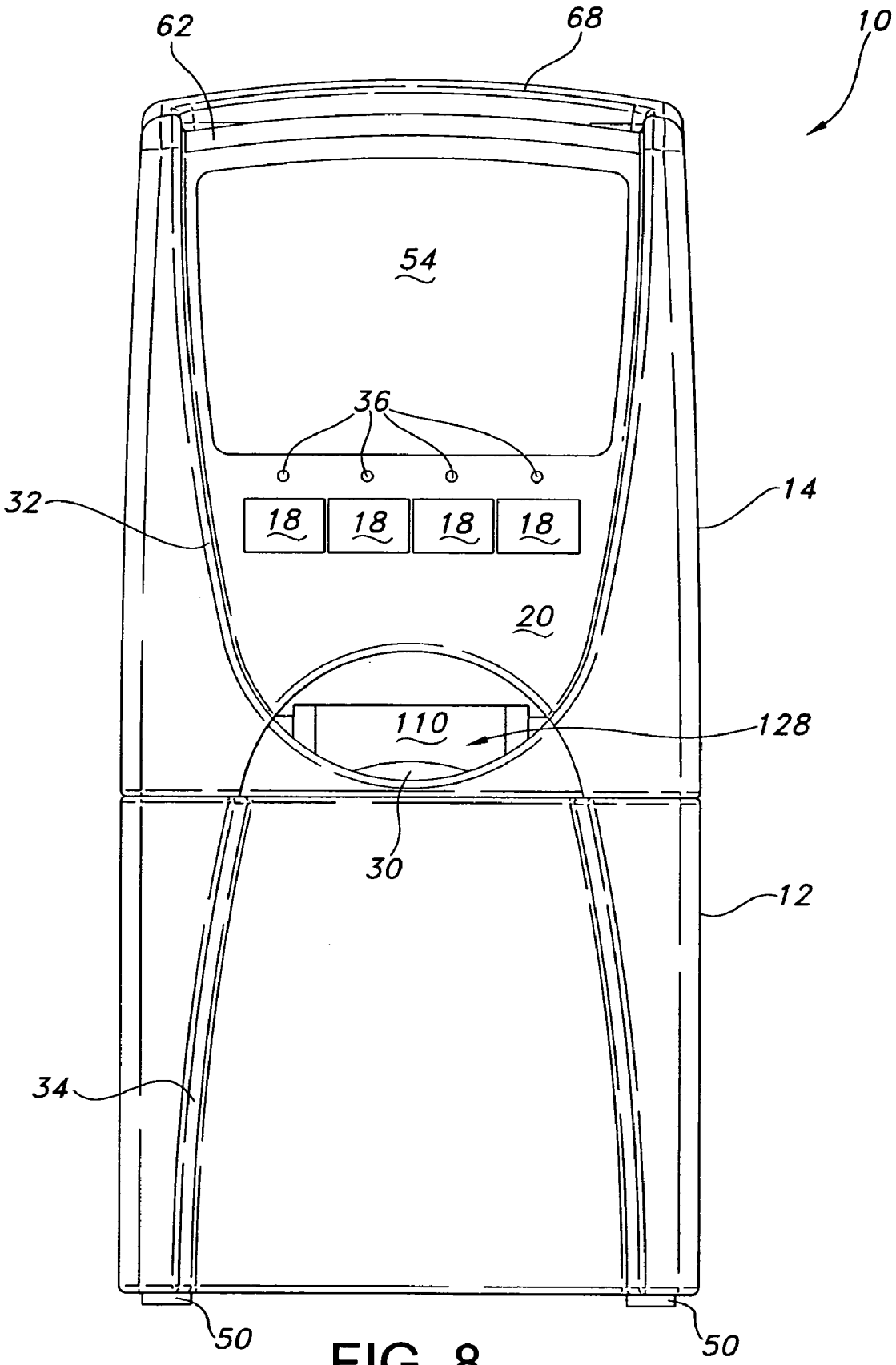
FIG. 8 is a front elevation of a dispenser on a stand according to one embodiment of the present invention.
Figure 9:
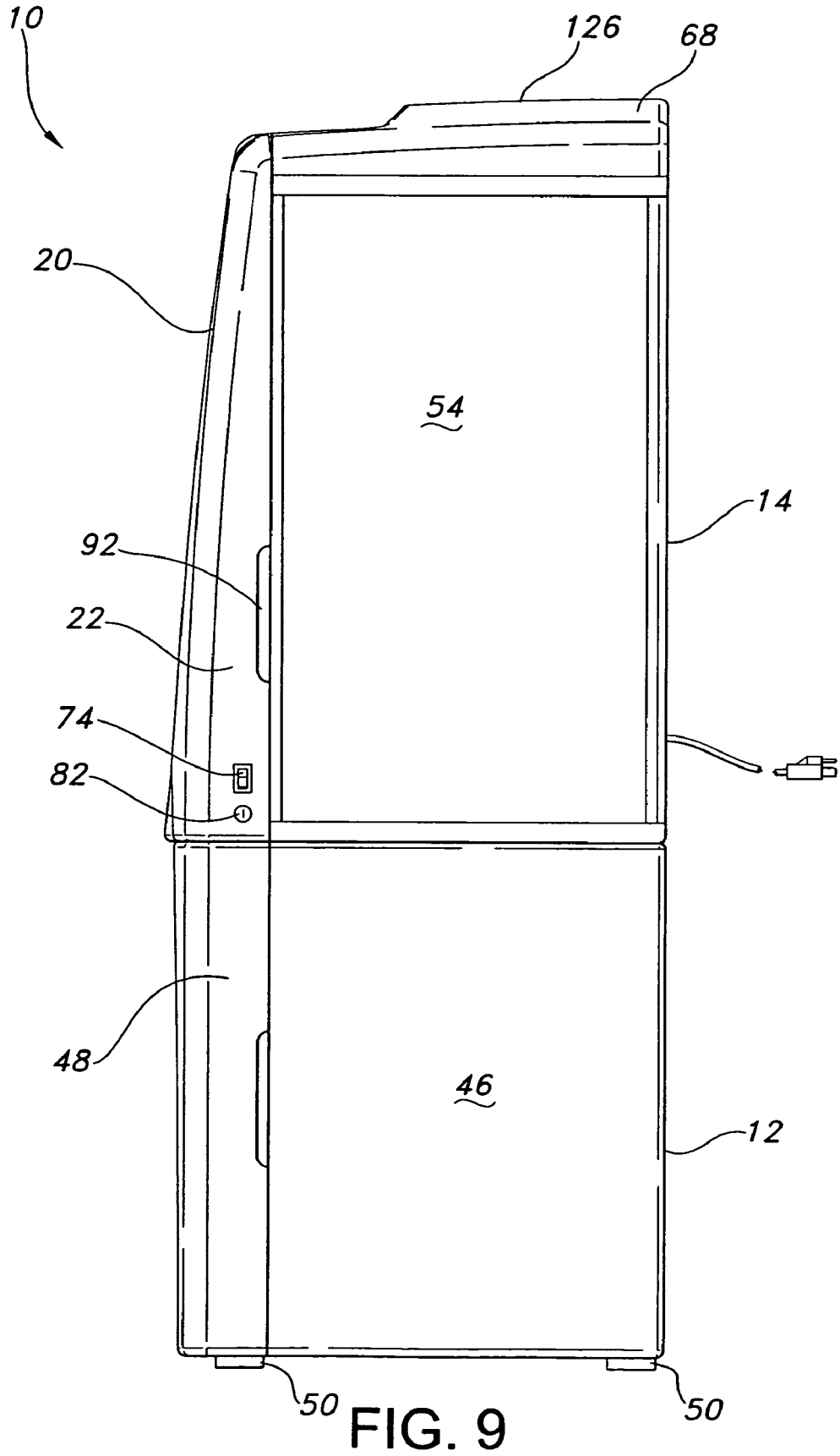
FIG. 9 is a side elevation view of the dispenser of FIG. 8.
Figure 10:
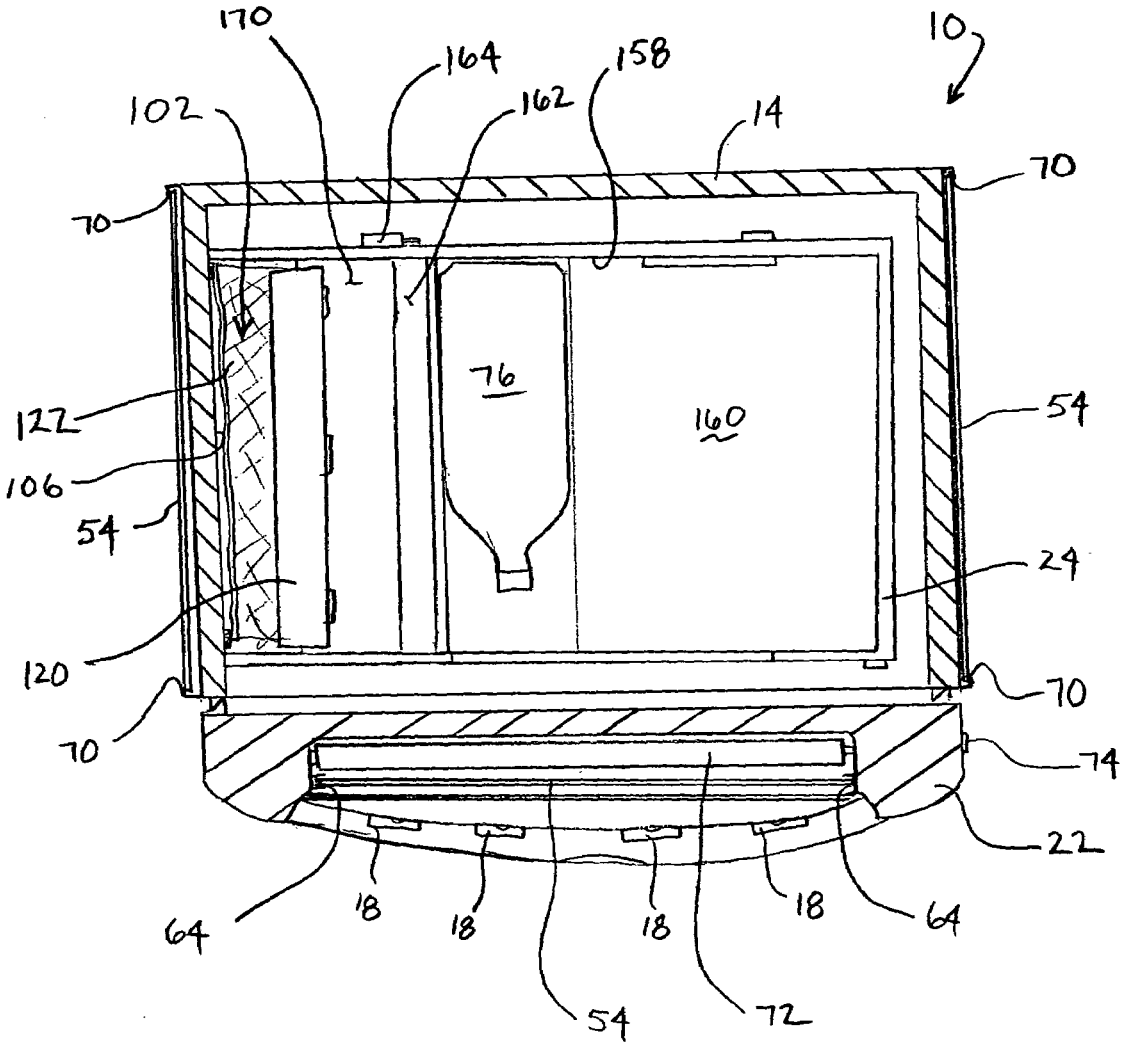
FIG. 10 is cross-sectional plan view of an embodiment of a dispenser according to the present invention.

FIGS. 8, 9 and 13 illustrate an inventive feature of the present invention in the form of a convexly curved top surface 126. The curve of the top surface 126 prevents heavy objects, such as a television or a case of soda, from easily resting on the top of the dispenser 10. This is especially important when the dispenser 10 is attached to the stand 12, because the placement of such heavy objects on the top surface 126 can tend to make the overall combination somewhat top-heavy and prone to tipping. It also increases the load on the supporting stand 12. By discouraging the placement of televisions and the like on top of the dispenser 10, the overall safety of the unit is increased. The curvature in the embodiment shown in FIGS. 8, 9, and 13 is primarily a side-to-side curve. However, it may also be effect to provide a front to back curvature as well (see FIG. 9). Additionally, it is contemplated that a side-to-side slope, or a back-to-front slope might accomplish the goal of discouraging the placement of heavy objects on the top surface 126.

Figure 14:
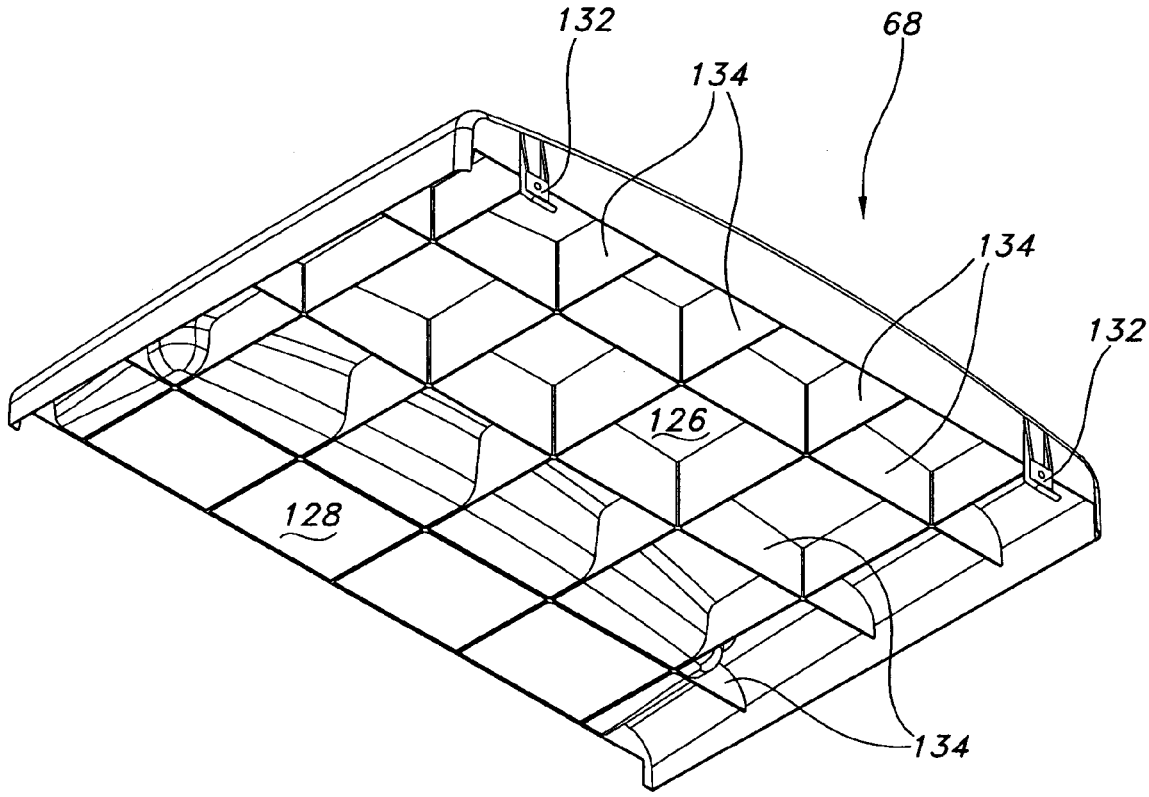
FIG. 14 is a perspective view of a piece used to form a top of the dispenser of FIG. 13.
Figure 15:
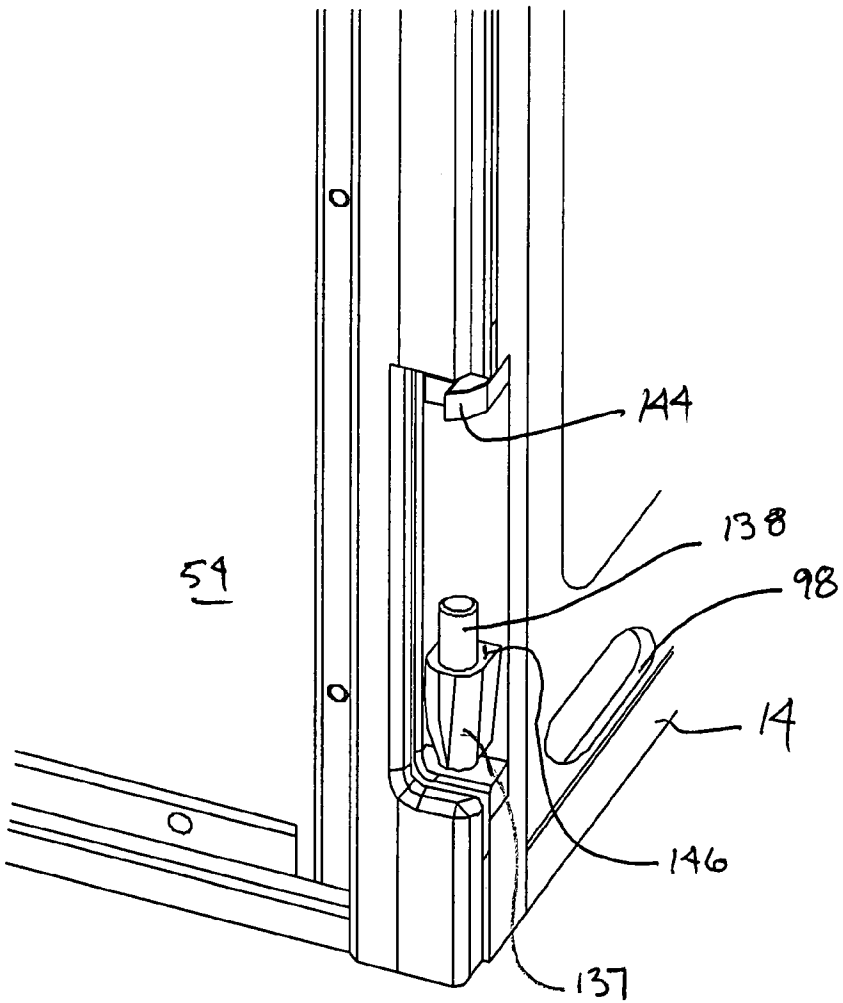
FIG. 15 is a partial detail view of a cabinet showing a male portion of a hinge assembly.

As an additional feature for the top surface 126, best illustrated in FIGS. 1 and 13, the curved top surface 126 of the dispenser 10 may be provided with a small flat level portion 128 that is suitable for resting individual cans 78 or bottles 78. Preferably, and as shown in the FIGS. 1 & 2, this small flat level portion is provided at a front edge of the top surface of the cabinet 14 portion of the dispenser 10. The door 22 may have a corresponding flat level portion 130 on its top edge that matches the flat level portion 128 on the top of the dispenser 10, or the door 22 may have a curved top surface the matches the curved top surface of the dispenser 10. Preferably the top 68 of the dispenser 10 is formed from a single piece that rests on the top of the cabinet 14 and fastens in place with clips 132 provided at the back of the top 168. While any suitable material may be used, an injection molded plastic piece is preferred to form the complex shape. FIG. 14 shows the bottom of a preferred piece for forming the top 68 of the dispenser 10. As can be seen in FIG. 14, the top surface of the top piece 68 is reinforced by a grid of reinforcing ribs 134 to provide stiffness to the front 128 and rear 126 portions of the top 68.

Another unique feature of the present invention is illustrated in FIGS. 15–18. A hinge 136 is provided that will permit removal of the dispenser door 22 by opening the door 22 beyond a certain point with respect to the cabinet 14, and then lifting the door 22. In the embodiment of FIGS. 15–18, the door 22 can be lifted on and off when it is open more than approximately 90 degrees with respect to the cabinet 14.

Figure 16:
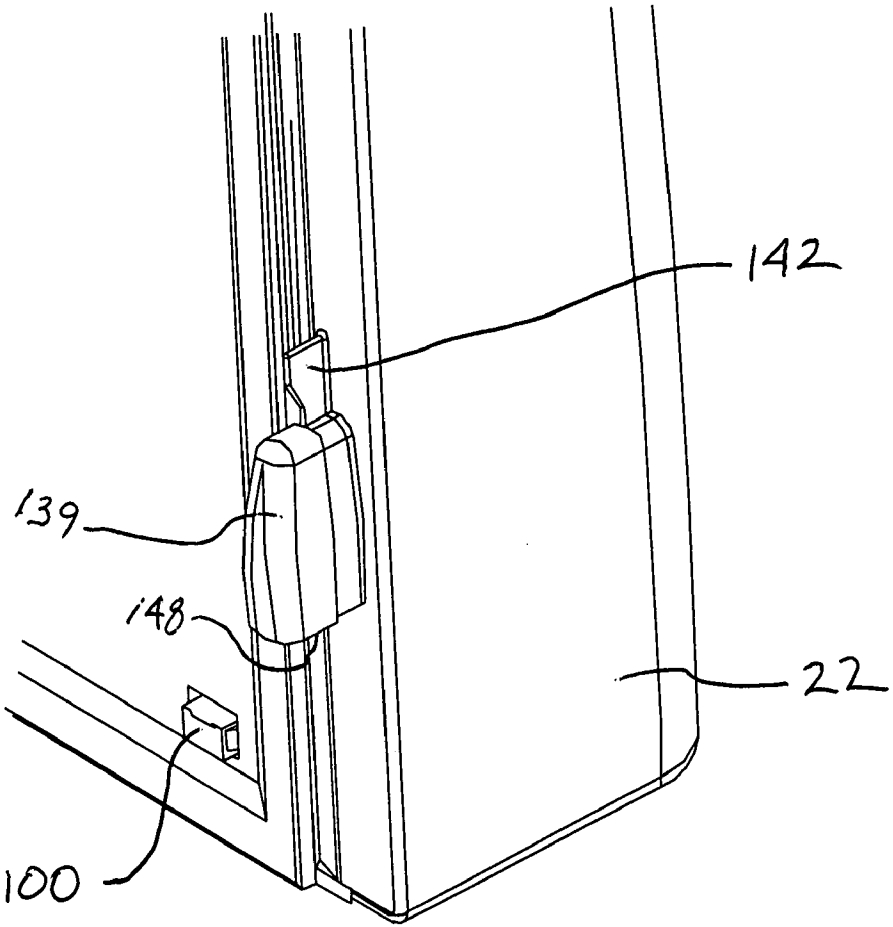
FIG. 16 is a partial detail view of a door showing a female portion of a hinge assembly.
Figure 17:
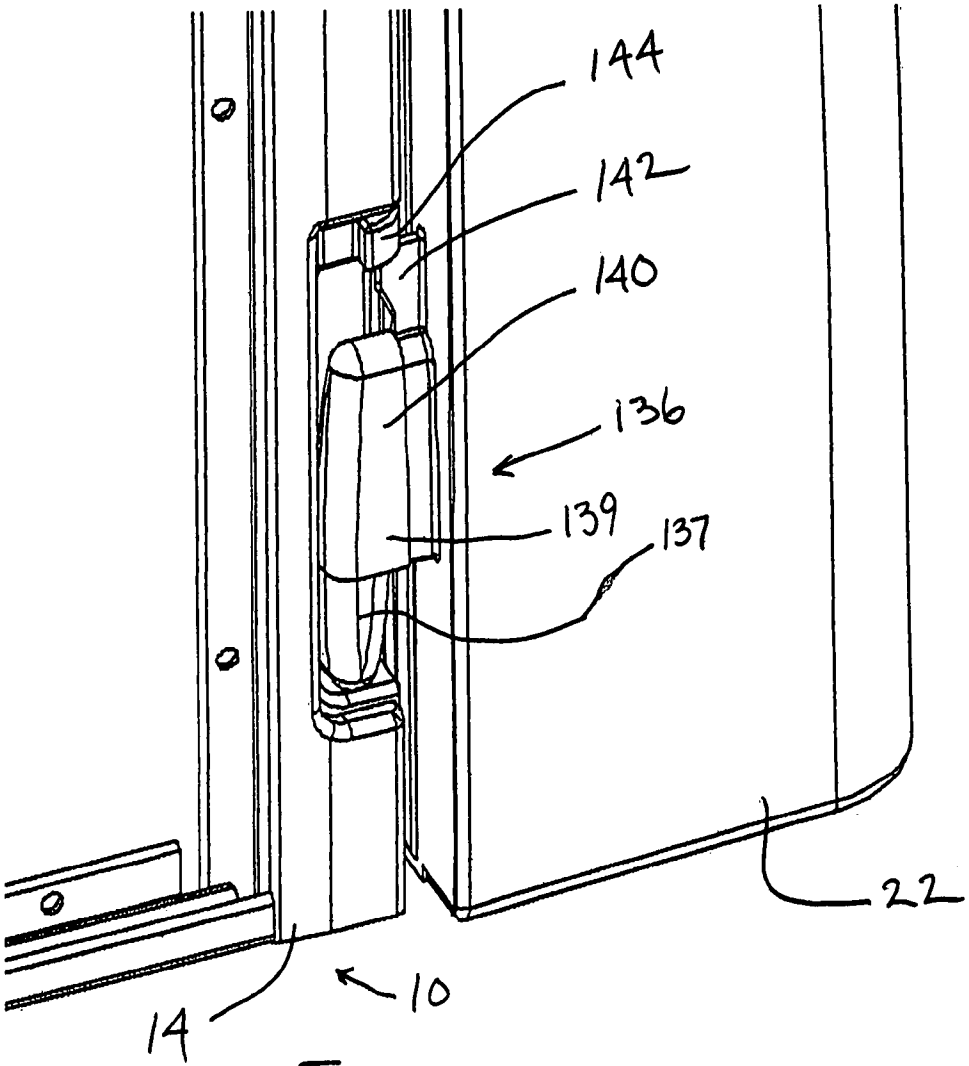
FIG. 17 is a partial detail view of the door of FIG. 16 mounted on the cabinet of FIG. 15 to form a hinge assembly.

The hinge 136 includes a male portion 138 and a female portion 140. In the embodiment shown in FIGS. 15–18, the male portion 138 is provided on a bottom hinge portion 137 on the cabinet 14 and points upward (FIG. 15), and the female portion 140 is provided as a top hinge portion 139 on the door 22, and faces downward (FIG. 16). The top hinge portion 139 includes a downward facing surface 148 that serves as a bearing surface. The bottom hinge portion 137 includes an upward facing shoulder 146 that acts as a corresponding bearing surface. The male 138 and female 140 portions could be reversed (not shown). The top hinge portion 139 is mounted to the door 22 exterior to the sealing gasket 214. The door portion of the hinge includes a tab 142, and the cabinet portion includes a catch 144. When the door 22 is closed, as shown in FIG. 17, the male 138 and female 140 parts are in mated engagement with the downward facing surface 148 of the top portion 139 resting on the shoulder 148 of the bottom portion 137, and the catch 144 interferes with the tab 142 to prevent lifting the door 22. When the door 22 is open at more than 90 degrees, there is no interference between the tab 142 and the catch 144, and the door 22 can be removed from the cabinet 14 simply lifting the door 22 to disengage the male 138 and female 140 portions of the hinge 136.

Figure 18:
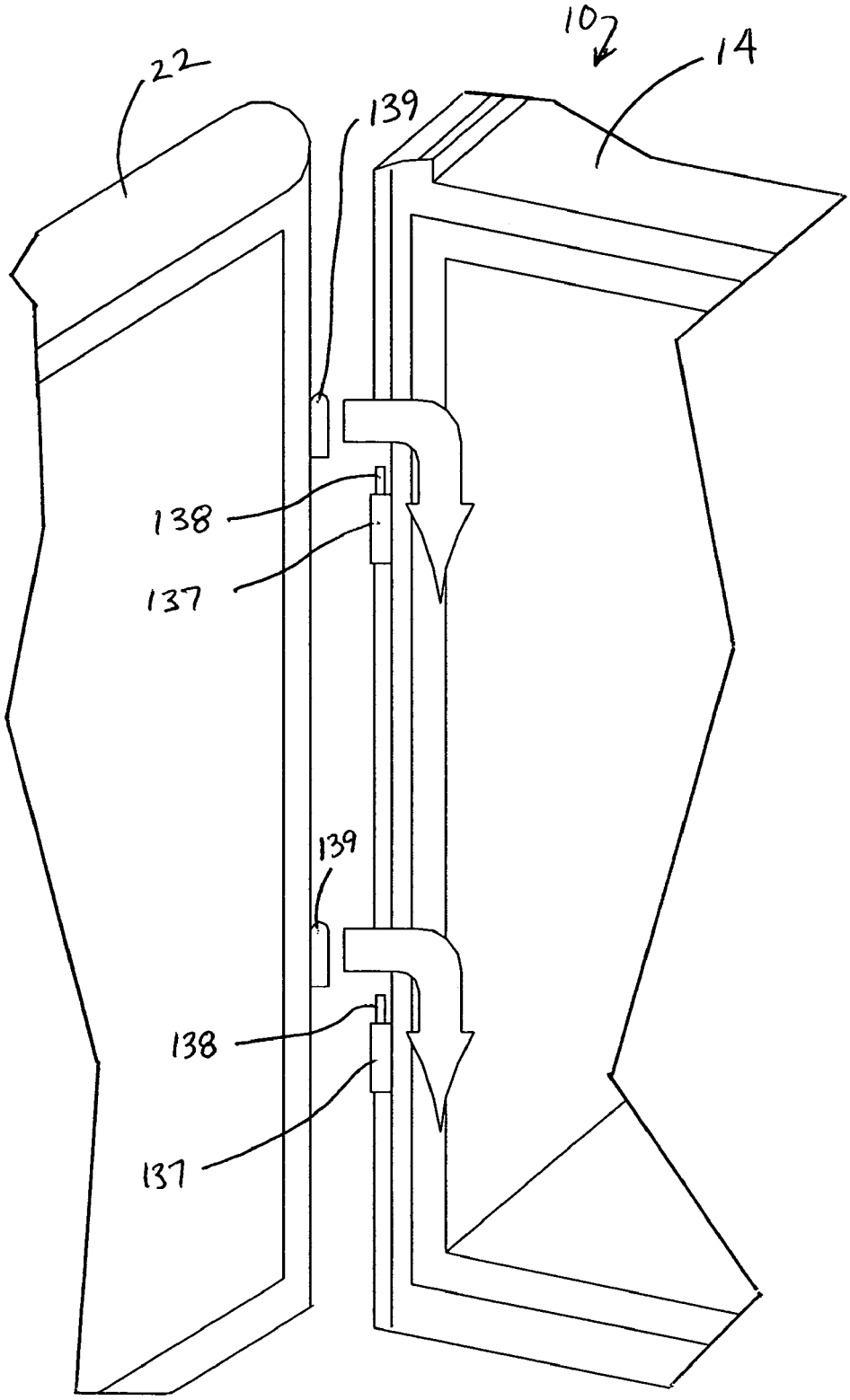
FIG. 18 is a graphic illustrating the installation of a door on a cabinet according to one embodiment of a hinge assembly of the present invention.

Installation of the door 22 is similarly simple. The door 22 is simply placed at an orientation of greater than 90 degrees with respect to the cabinet 14 with the male 138 and female 140 parts in proper alignment and then lowered into place as shown in FIG. 18. Two or more sets of such hinges 136 may be used. Preferably the hinges 136 are recessed somewhat into the cabinet 14, as seen in FIG. 16, so that the hinges 136 do not extend the width of the dispenser 10, and to improve the appearance of the dispenser 10. The hinges 136 preferably should be made sufficiently strong to support the weight of the dispenser 10, if the dispenser is lifted by the door 22. Preferably the hinges 136 are made of a smooth, relatively low friction material so that the door 22 will open easily. The male and female portions 138 and 140, as well as the facing surfaces 146 and 148 should be durable enough that they can withstand rubbing during opening and closing of the door 22 without significant wear.

The easy removal and installation of the door 22 is desirable because it allows for easier packing and shipping of the door 22 and cabinet 14 in separate containers. In a preferred embodiment, the cabinet 14 without the doors 22 is small enough that it can shipped by standard commercial delivery services. Preventing the door 22 from separating from the cabinet 14 when the door 22 is closed, or open less than 90 degrees, permits the dispenser 10 to be lifted by the door 22 (though use of the cabinet 14 is recommended). That way, if a user attempts to move the dispenser 10 by lifting on the door 22, the door 22 will not come apart from the cabinet 14.

FIGS. 19A–D illustrate a preferred selection button 18 design. According to the design, a clear plastic selection button 18 is provided to correspond with each storage bin 24. When the selection button 18 is pressed, the corresponding dispensing mechanism 80 vends one of the cans 78 or bottles 76 in the storage bin 24. A flavor card 150 that describes the beverage in the corresponding storage bin 24 is inserted in the clear plastic button 18. In the embodiment shown in the Figures, there are four buttons 18 and four storage bins 24. The left most button 18 corresponds to the upper storage bin 24*t*, the next button to the right corresponds to the second highest storage bin 24, and so forth. Other arrangements would be acceptable.

Figure 19A:
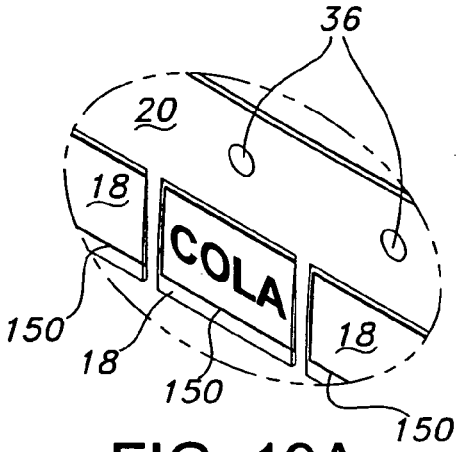
FIG. 19 is a detail perspective of an embodiment of a selection button with removable flavor card according to the present invention.
Figure 19B:
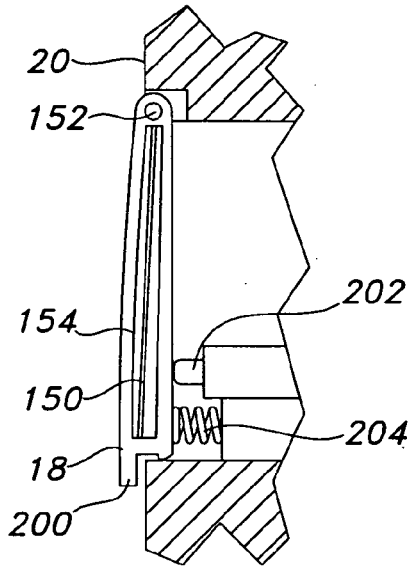
Figure 19C:
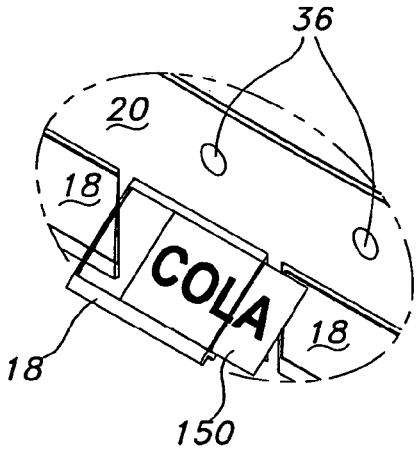
Figure 19D:
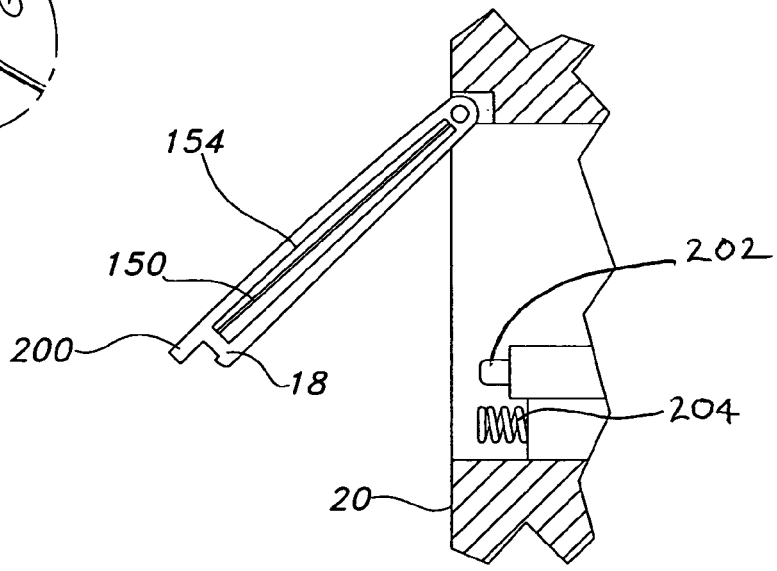

What has been described related to the vending buttons 18 thus far is common and known in the vending art. However, typically access to the flavor card 150 is restricted from outside of the dispenser 10 so that vandals or other unauthorized users cannot remove, damage, or change the flavor cards 150. Generally access to the flavor cards can only be gained by using a key or other tool. In the embodiments shown in FIGS. 19A–D, the selection buttons are hingedly attached to the front of the dispenser 10. They can be pivoted to an open orientation (FIGS. 19C & D) by simply pulling on the edge of the buttons 18 that is opposite from the hinge 152. In the preferred embodiment shown in FIGS. 19A–D, the hinge 152 for each button 18 is provided along the top of the selection button 18 at a generally horizontal axis. Access to the flavor cards 150 is provided by pulling outward and upward on the bottom edge of the buttons 18. The hinge 152 could be provided along the bottom or one of the sides of the button 18 instead. Each button 18 is provided with a pocket 154 or slot for retaining a flavor card 150. Once the button 18 is pivoted to the open position, the flavor card 150 can be slid into and out of the pocket 154 or slot. The top-mounted hinge 152 of FIGS. 19A–D permits gravity to urge the button 18 into the closed position (FIGS. 19A & B). A projection 200 may be provided at an edge of the button 18 opposite from the hinge 152 to provide a surface to pull on when moving the button 18 to the open position (FIGS. 19C & D) and to prevent the button 18 from being depressed too far into the front 20 of the dispenser 10. There may be a slight interference between the free end 202 of the button 18 and the front 20 of the dispenser 10, which will tend to hold the button 18 in place.

When the button 18 is depressed to make a selection, it activates a selection switch 202. Also, the button 18 may be biased by biasing mechanism 204 to return it to a neutral position after it has been pressed to make a selection. Those of skill in the art will be aware of numerous options for switch 202, and for biasing mechanism 204.

The flavor cards 150 may be preprinted with logos and brand names of common beverages, or may be plain so that a user can customize the flavor card 150 to match any flavor. The cards 150 may be printed with flavor information on one or both sides.

It is contemplated that the buttons 18 could be replaced by, or used in conjunction with, a remote selection system. According to this embodiment, a remote control unit would be used to signal a selection of a storage bin 24 from which to dispense a bottle 76 or can 78. A sensor is provided on the dispenser 10, preferably on the front 20 near the selection buttons 18. The sensor would translate a signal from the remote control unit to the appropriate storage bin to initiate dispensing of a bottle or can from the selected storage bin 24. Most preferably the remote control unit would send an IR signal, but an RF signal may be used. The remote control unit may be a dedicated device, or may be a shared device that is also used to control other electrical appliances such as televisions and stereos.

Shown generally in FIGS. 21–24 are storage bins 24 that are used to hold the cans 78 or bottles 76 in the refrigerated storage area. The storage bins 24 are preferably modular trays that can be stacked on top of each other. They are comprised primarily of a one piece body with a dispensing mechanism 80 attached at one end. They are provided with interlocking tabs 206 and receivers 208 to hold the stacked bins 24 together. Fasteners, such as screws, bolts, rivets, brads, or the like may be used to further secure the bins 24 together at the tabs 206 and receivers 208. When stacked on top of each other the bottom surfaces 160 of the trays 24 generally slope towards one side. In the embodiment shown in FIG. 11, they slope to towards the left side of the cabinet 14. The slope may be introduced by the shape of the bottom surfaces 160, or by stacking the trays 24 on a sloped support surface within the cabinet 14. The preferred slope of the bottom surfaces 160 is approximately five degrees. Cans 78 and bottles 76 are loaded into the storage bins 24 with their axes generally perpendicular to the front of the dispenser 10. FIGS. 20*a* and *b* and 24 show how the cans 78 and bottles 76 are oriented in the storage bin 24 when they are in storage prior to being dispensed. The slope of the bottoms 160 of the storage bins 24 causes the bottles 76 and cans 78 to roll towards the left end (in this embodiment) of the storage bin 24. At the lower end of the storage bin 24 a dispensing mechanism 80 is provided.

Figure 24:
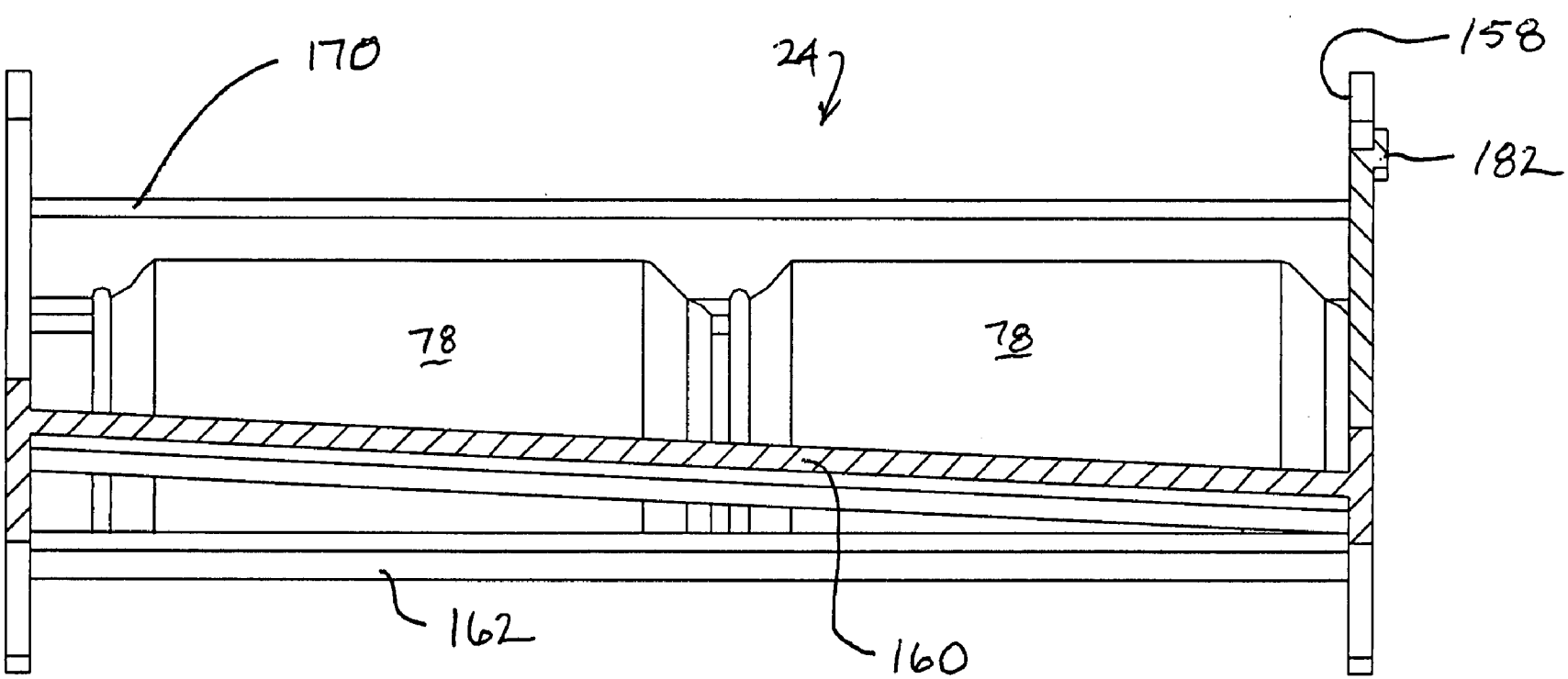
FIG. 24 is a cross sectional view of the stack of storage tray from FIG. 21.

When loading the cans 78 or bottles 76 into the storage bins 24, the first bottle 76 or first two cans 78 will roll towards the dispensing mechanism 80. If the dispensing mechanism 80 is not full, the first two cans 78 or first bottle 76 loaded will fall into the dispensing mechanism 80. The loaded cans 78 or bottles 76 are stored in an offset stacked arrangement such that in the second layer of cans 78 or bottles 76 each of the cans 78 or bottles 78 rests on two cans 78 or bottles 76 in the layer immediately beneath it (see FIGS. 20*a* and 20*b*). The side of the storage bin 24 opposite from the vending mechanism is provided with a sloped wall 156. When loading the cans 78 or bottles 76 into the storage bins 24 for storage, the sloped wall 156 helps maintain the cans 78 or bottles 76 in an appropriate stacked formation. Preferably, when bottles are loaded into the storage bins 24, the bottles 76 are loaded so that their base is against the rear wall 158 and their necks extend towards the front of the bins 24, as shown in FIGS. 20*a* and 24. As the cans 78 or bottles 76 fall into the dispensing mechanism 80, they automatically unstack themselves.

Figure 23:
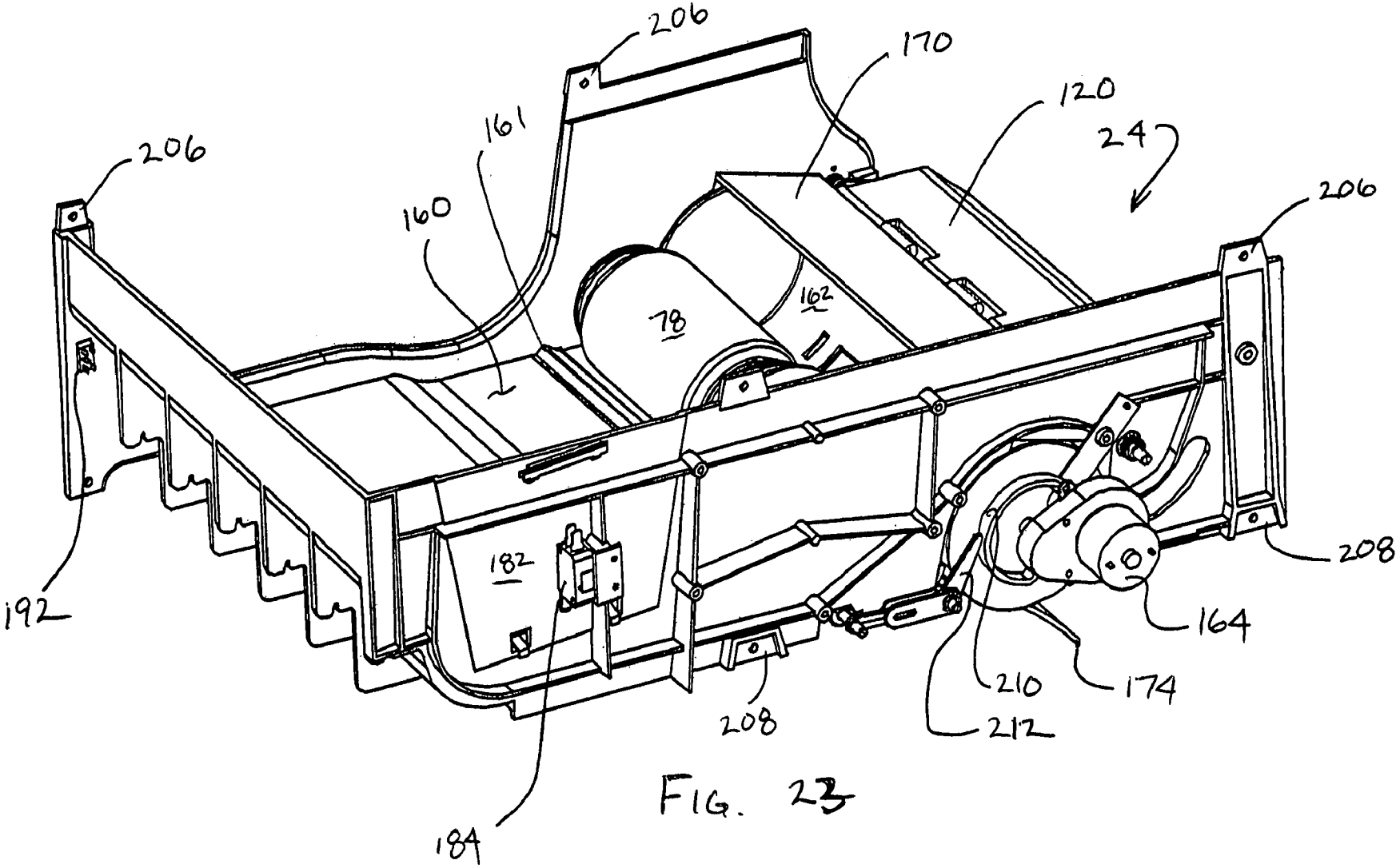
FIG. 23 is a rear perspective view of a storage bin with two cans in the storage bin.

As seen in FIGS. 20*b* and 23, two cans 78 will fit in the storage bin end-to-end with their axes generally perpendicular to the front of the dispenser 10. A standard twelve ounce bottle 76 is approximately the same height as two twelve ounce cans 78 stacked on top of each other. Therefore, typically only one bottle 76 will fit within the same space as two cans 78, so that the storage bins 24 can hold twice as many cans 78 as bottles 76. The cans 76 and bottles 78 can also be stacked in layers within the individual storage bins as shown in FIGS. 20*a* and *b*.

Preferably at least a portion of the bottom surfaces 160 of the modular trays 24 are also sloped somewhat from front to back, as best illustrated in FIG. 24, such that the cans or bottles are urged towards the rear wall 158 of the storage bins 24 by gravity, especially when they roll along the bottom 160 of the tray towards the vending mechanism 80. As noted, bottles 76 should be loaded such that their necks point towards the front of the storage bins 24 in order to maintain the appropriate orientation of the bottles 76. The front-to-back slope of the storage bin bottoms 160 also helps to maintain the bottles 76 and cans 78 within the storage bins 24 so that the bottles 76 and cans 78 are not inadvertently spilled out of the bins 24 when the door 22 is opened. It may be desirable to have the portion of the bottom surface 160 that is nearest the dispensing cup 164 to be flat, without the front to back slope, in order to improve the loading of the dispensing cup 164. The preferred front to back slope to urge the cans 78 or bottles 76 towards the rear wall 158 is about two degrees.

Any number of modular trays 24 may be stacked upon each other depending the size of the dispenser 10 and the number of options for flavors desired. In the embodiment shown in FIG. 11, four such modular trays 24 are used. The top bin 24*t* is slightly shorter than the other bins 24 when viewed from the front in order to maximize space within the dispenser 10. In the embodiment shown, the lower bins 24 will each hold sixteen cans—two layers with eight cans 78 in each layer. Additionally, the vending mechanism 80 will hold two cans 78. Therefore, each of the bottom three storage bins 24 will hold eighteen cans. Accordingly, each of the lower three bins 24 will hold nine bottles 76—eight in the storage bin 24 itself and one in the vending mechanism 80. In the embodiment shown, the top storage bin 24*t* will hold ten cans 78, or five bottles 76—one lower layer with eight cans 78 or four bottles 78, and one upper layer with two cans 78 or one bottle 76. An additional two cans 78 or one bottle 76 may be stored in the vending mechanism 80. Accordingly, the entire dispenser 10 will store as many as sixty-six cans 78 or thirty-three bottles 76. The exact size of the storage bins 24 is not important to the functioning of the dispenser 10 and they can be adjusted by those of skill in the art to suit the capacity constraints and number of flavor choices desired. The modular nature of the bins 24 is advantageous as it saves on manufacturing costs and assembly.

The dispensing mechanism 80 is a mechanism for moving one can 78 or bottle 76 at a time from the storage bins 24 to the dispensing path 102 in response to a selection made by pressing one of the selection buttons 18. Numerous dispensing mechanisms are known in the vending art and would work with the storage bins 24 described herein. The preferred vending mechanism 80 is a rotating cup type dispenser. A rotating cup dispensing mechanism 80 basically comprises a dispensing cup 162 attached to a motor 164 that selectively rotates the dispensing cup 162. The dispensing cup 162 is generally a hollow semicylindrical shape. The cans 78 or bottles 76 fall from the tray 24 into the dispensing cup 162 by gravity to load the dispensing mechanism 80 when the open side of the dispensing cup 162 is facing upwards. The motor 164 then turns the cup 162 until the open side is facing sideways, and gravity causes the can 78 or bottle 76 to fall out of the cup 162 into the dispensing path 102. Because the modular trays 24 and the dispensing cup 162 are sized to hold either two cans 78 end-to-end or one bottle 76, all of the storage bins 24 can be used to vend bottles 76 or cans 78 without the need for any adjustment.

Two inventive vending mechanisms 80 are described in more detail below. According to a first embodiment, shown in FIG. 25, a dispensing cup 162 has a staggered trailing edge 166. According to a second embodiment, shown in FIG. 26, a rear barrier wall 168 is used in proximity to the dispensing cup 162. Both of these embodiments permit the dispensing cup 162 to vend two cans 78, one at a time, as the dispensing cup 162 rotates a complete rotation.

The sketches in FIG. 27 show a graphic generalized vending sequence according to the present invention. In FIG. 27*a* the dispensing mechanism 80 is in the loading position. Gravity has forced two cans 78 to be loaded into the dispensing cup 162. The two cans 78 in the dispensing cup 162 contact the next cans 78 in line behind them and prevent them from falling into the dispensing cup 162. In FIG. 27*b* the dispensing cup 162 has started to rotate. The dispensing cup 162 contacts the next cups in line on the vending tray 24, and holds them in place. A barrier 170 or stop above the dispensing cup 162 prevents the cans 78 from rolling too far over the dispensing cup 162. A one-way flap 161 or other structure may be provided on the bottom surface 160 of the storage bin 24 to prevent the can 78 or bottle 76 immediately next to the dispensing cup 162 from being rolled away from the dispensing cup 162.

Figure 27A:
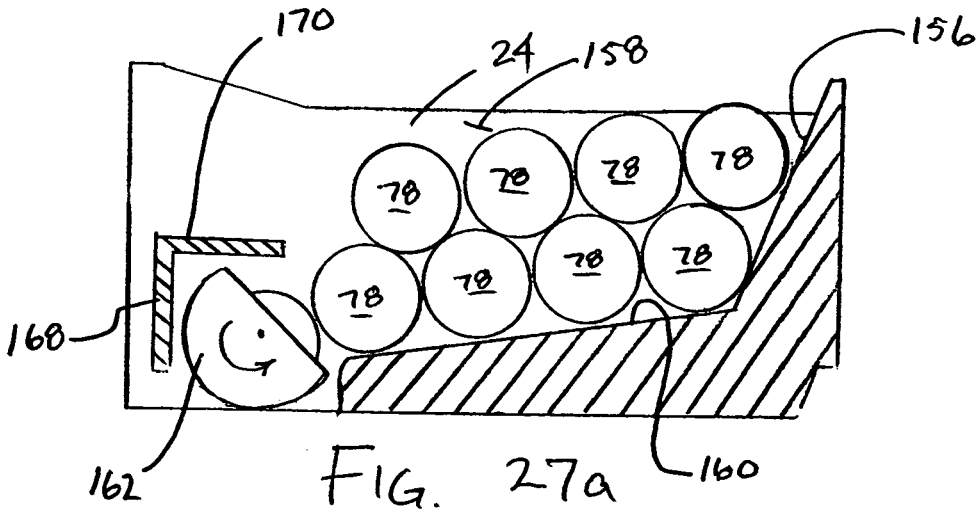
FIG. 27 is a graphic illustrating a vending sequence according to one embodiment of the present invention.
Figure 27B:
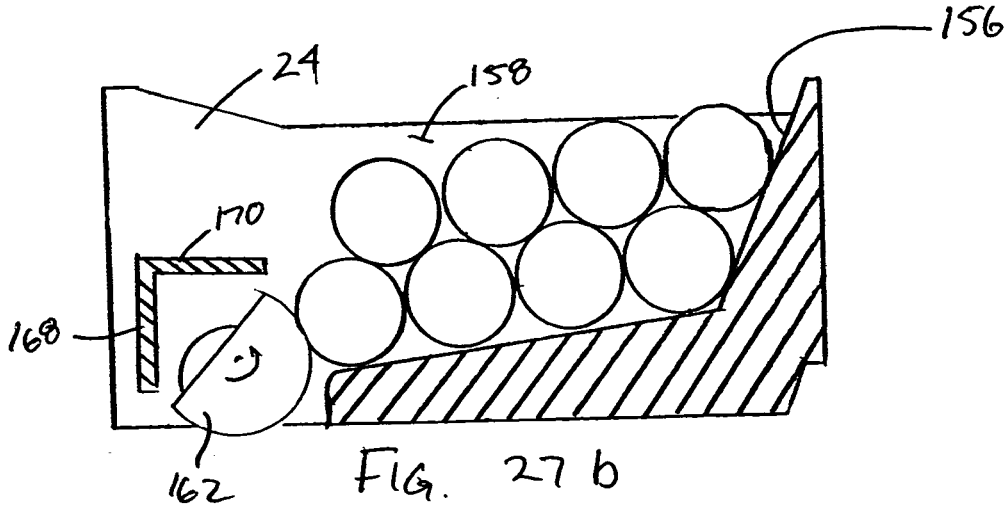
Figure 27C:
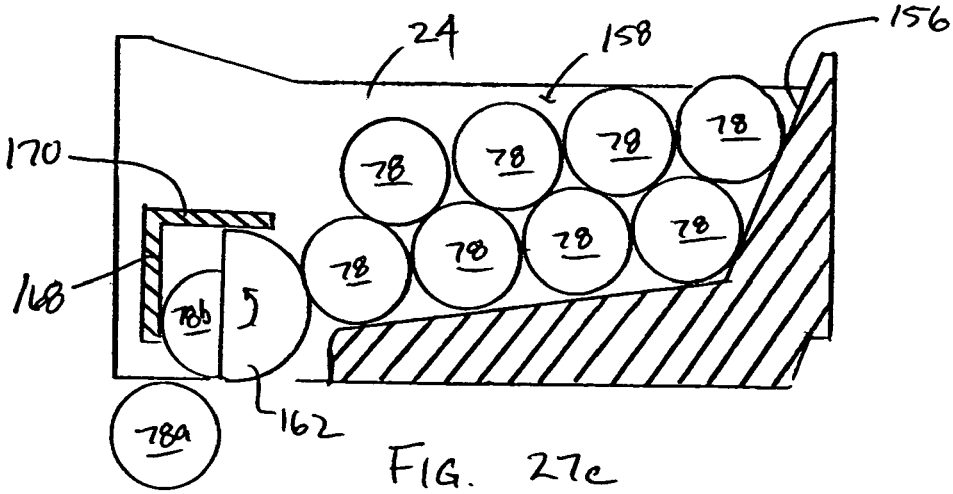
Figure 27D:
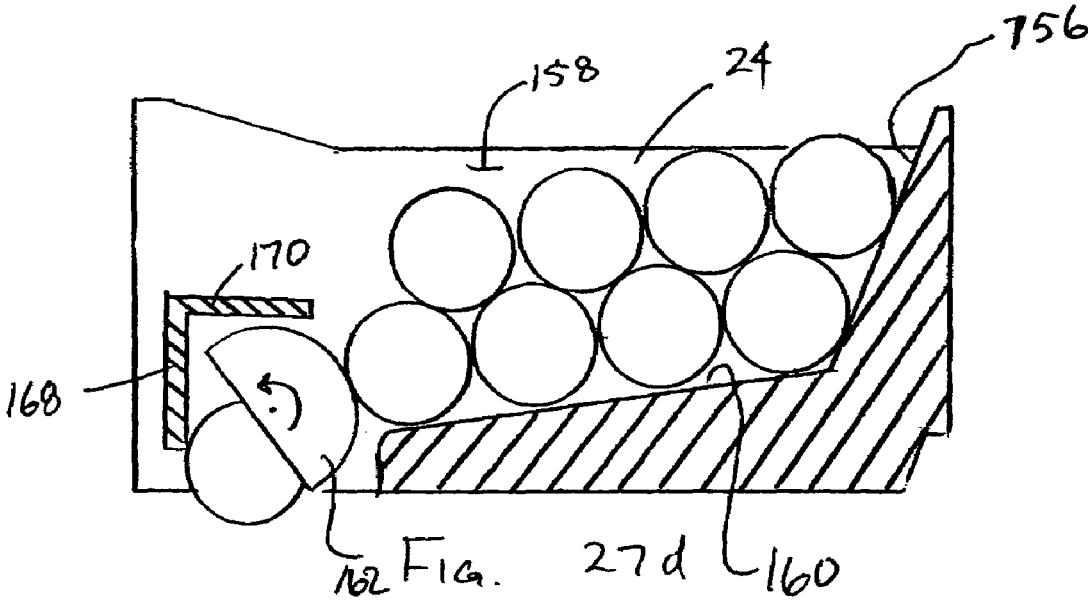
Figure 27E:
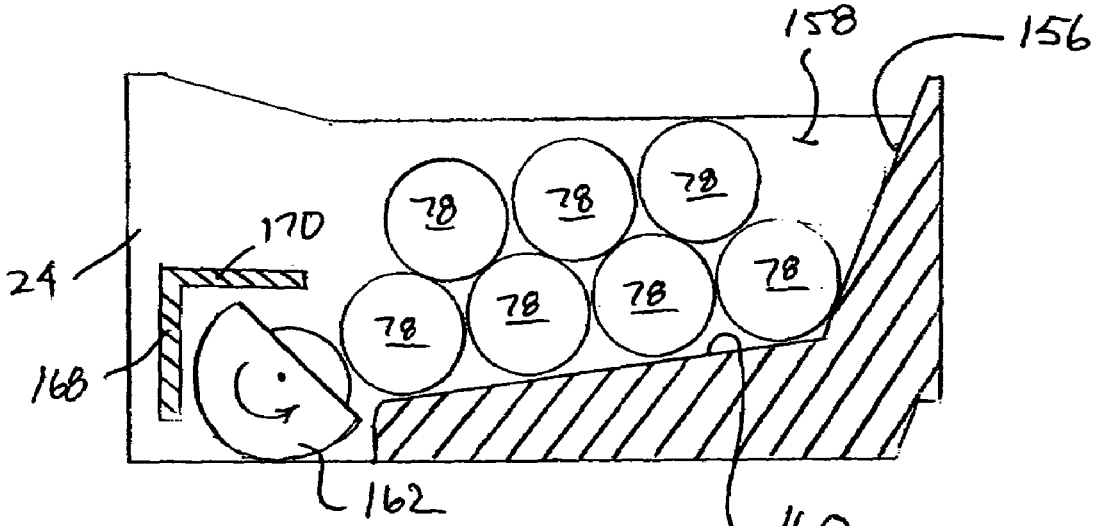

Alternatively, FIG. 27*b* can be a staging position where the dispensing cup remains after loading, but before it has been activated in response to a selection by one of the selection buttons 18. This staging position of FIG. 27*b* decreases the time it takes between a selection being made, and a bottle or can being dispensed. FIG. 27*c* shows a first dispensing position. In this position, the dispensing cup 162 has turned far enough that a first can 78*a* falls out of the dispensing cup 162. Preferably the falling first can 78*a* will trip a sensor 172 that causes the dispensing cup 162 to stop rotating. The second can 78*b* remains retained within the dispensing cup 162 by the barrier wall 168. In the staggered trailing edge embodiment of FIG. 25, the second can 78*b* remains retained in the dispensing cup 162 by the rear portion of the trailing edge 166. When the vending mechanism 80 is activated again in response to a selection being made, as for example by the corresponding selection button 18 being pushed, the dispensing cup 162 continues to turn until the second can 78*b* drops out into the dispensing path 102 as shown in FIG. 27*d*. The dispensing cup 162 will turn for a specified period after the second can 78*b* drops until the dispensing cup 162 reaches the loading position of FIG. 27*e*. The next cans 78 in position on the storage bin 24 will drop into the dispensing cup 162, and the remaining cans 78 will roll down the sloped bottom 160 of the storage bin 24 towards the dispensing mechanism 80 into the space just vacated by the cans 78 that dropped into the dispensing cup 162. The dispensing cup 162 may continue to turn until it reaches its normal resting position, the staging position of FIG. 27*b*.

If there was only a single can 78 or bottle 76 in the dispensing cup 164 at the beginning of the cycle, the dispensing cup 164 will still stop in the position of FIG. 27*c* after dispensing that single can 78 or bottle 76. However, upon the second selection being made for that dispensing cup 164, the dispensing cup 164 will continue to turn past 27*d*, and will continue to turn until it has loaded a new can 78 or bottle 76 and will return to the position of FIG. 27*c* to dispense another can 78 or bottle 76. In the preferred embodiment, the main controller will sense that it took a complete rotation to vend the second bottle 76 or can 78, and will continue to rotate all the way back to the staging position of FIG. 27*b*, rather than stopping at the position of FIG. 27*c*. In this way, the time lapse between pushing the selection button, and the dispensing of the can 78 or bottle 76 is diminished. Opening the main door 22 will reset the unit, and all dispensing cups 164 will stop after the next dispensing occurrence at or near the position of FIG. 27*c*.

A switch 172 is provided adjacent to the bottom of the dispensing cup 162 to sense when a can 78 or bottle 76 has been dispensed. In the shown embodiment, this contact switch 172 is activated by a spring-biased flipper 174 that the can 76 or bottle 78 must pass through to enter the dispensing path 102. After a selection button 18 is depressed to start a dispensing cycle, the dispensing cup 162 will continue to rotate until the system senses that a bottle 78 or can 76 has dropped out of that dispensing cup 162 and tripped the spring-biased flipper 174. If no product is dispensed after a specified time limit, or number of rotations, the motor 164 will stop and a malfunction signal will be given, for example by flashing some or all of the indicator lights 36.

Figure 25:
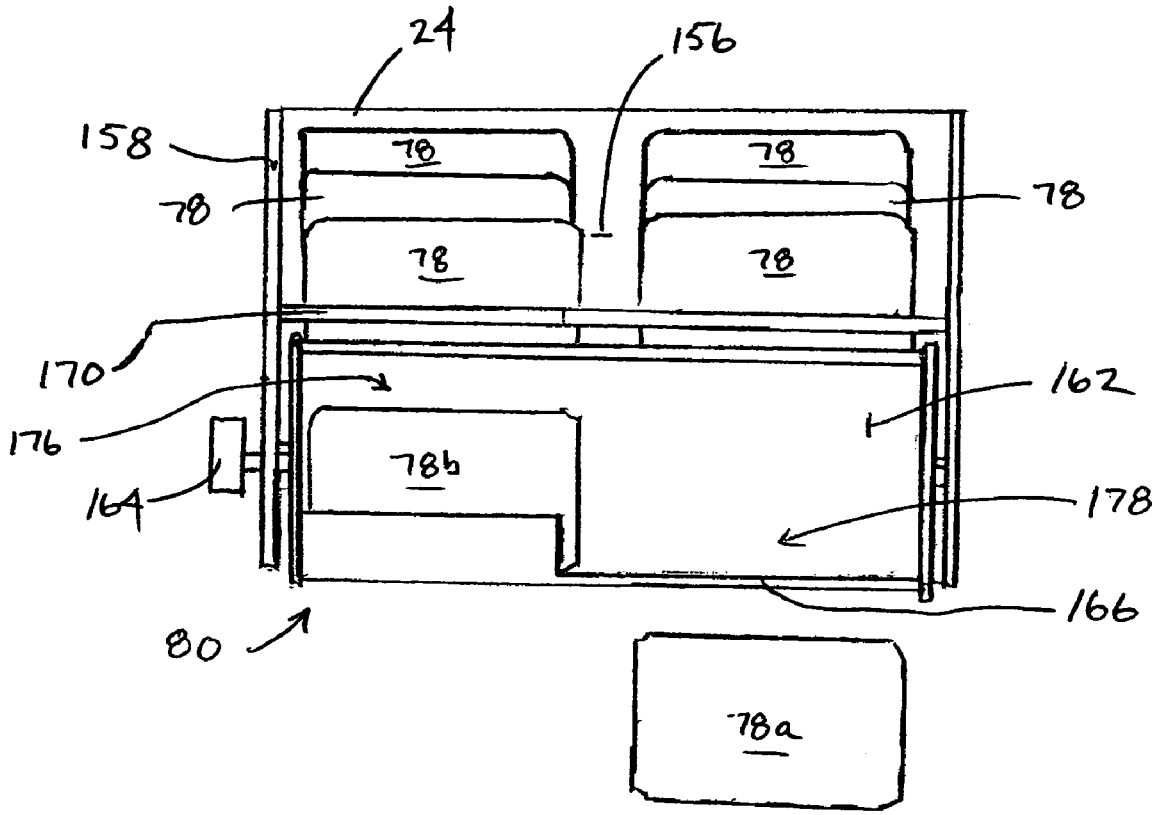
FIG. 25 is an end view of an embodiment of a dispensing mechanism using a staggered trailing edge on a dispensing cup with the dispensing cup dispending a first can but retaining a second can.

The trailing edge 166 of the dispensing cup 162 of FIG. 25 has stair step shape that permits a first can 78*a* to drop out of the dispensing cup 162 while the dispensing cup 163 still retains a second can 78*b*. Put another way, at the rear portion 176 of the dispensing cup 162 the solid portion extends farther around the axis of the cup 162 than at the front portion 178 of the dispensing cup 162. Therefore, a can 78*a* in the front position of the dispensing cup will drop out of the dispensing cup 162 before the can 78*b* in the rear position within the dispensing cup 162.

Preferably a cam 210 and a follower 212 are provided, as best seen in FIG. 23. The cam 210 rotates with the dispensing cup 164 and has an uneven diameter. The follower 212 rides on the cam 210 and creates resistance. The follower 212 would create the most resistance where the diameter of the cam 210 is the greatest and less resistance where the diameter of the cam 210 is smaller. The motor 164 senses the amount of current, which is dependent upon the amount of resistance to rotation, and thereby senses the position of the dispensing cup 164. Those of skill in the art may be aware of other mechanisms for sensing the position of the dispensing cup.

Figure 26:
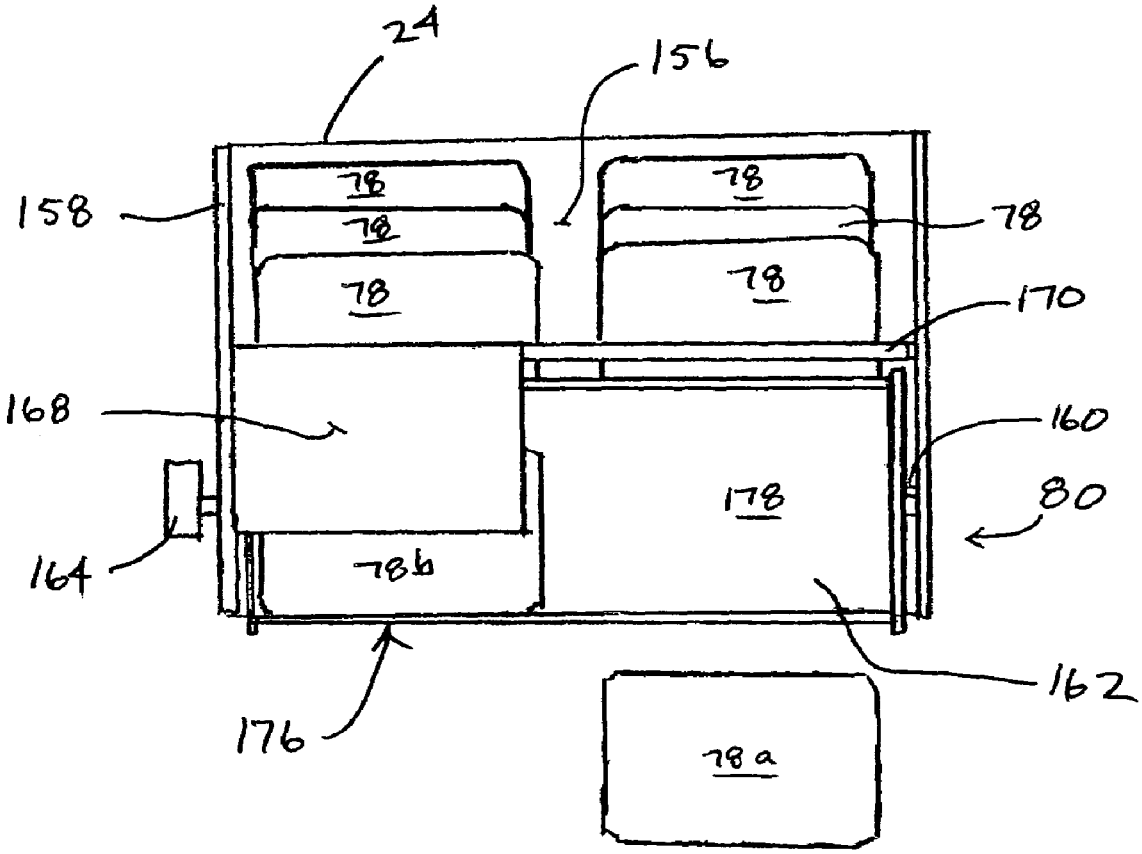
FIG. 26 is a side view of an embodiment of a dispensing mechanism that utilizes a barrier wall in combination with the dispensing cup with the dispensing cup dispensing a first can while the barrier wall retain a second can in the dispensing cup.

If the dispensing cup 164 completes a full rotation without dispensing any product The embodiment for dropping one can 78 at a time shown in FIG. 26 includes a rear barrier wall 168 that extends downward longitudinally along the open side of the dispensing cup 162. In the shown embodiment it extends downward from the top barrier 170 along the rear portion of the dispensing cup 162 to form rear barrier. As the dispensing cup 162 rotates it will drop the front can 78*a*, but the rear barrier wall 168 will prevent the rear can 78*b* from falling into the dispensing path 102.

Figure 12:
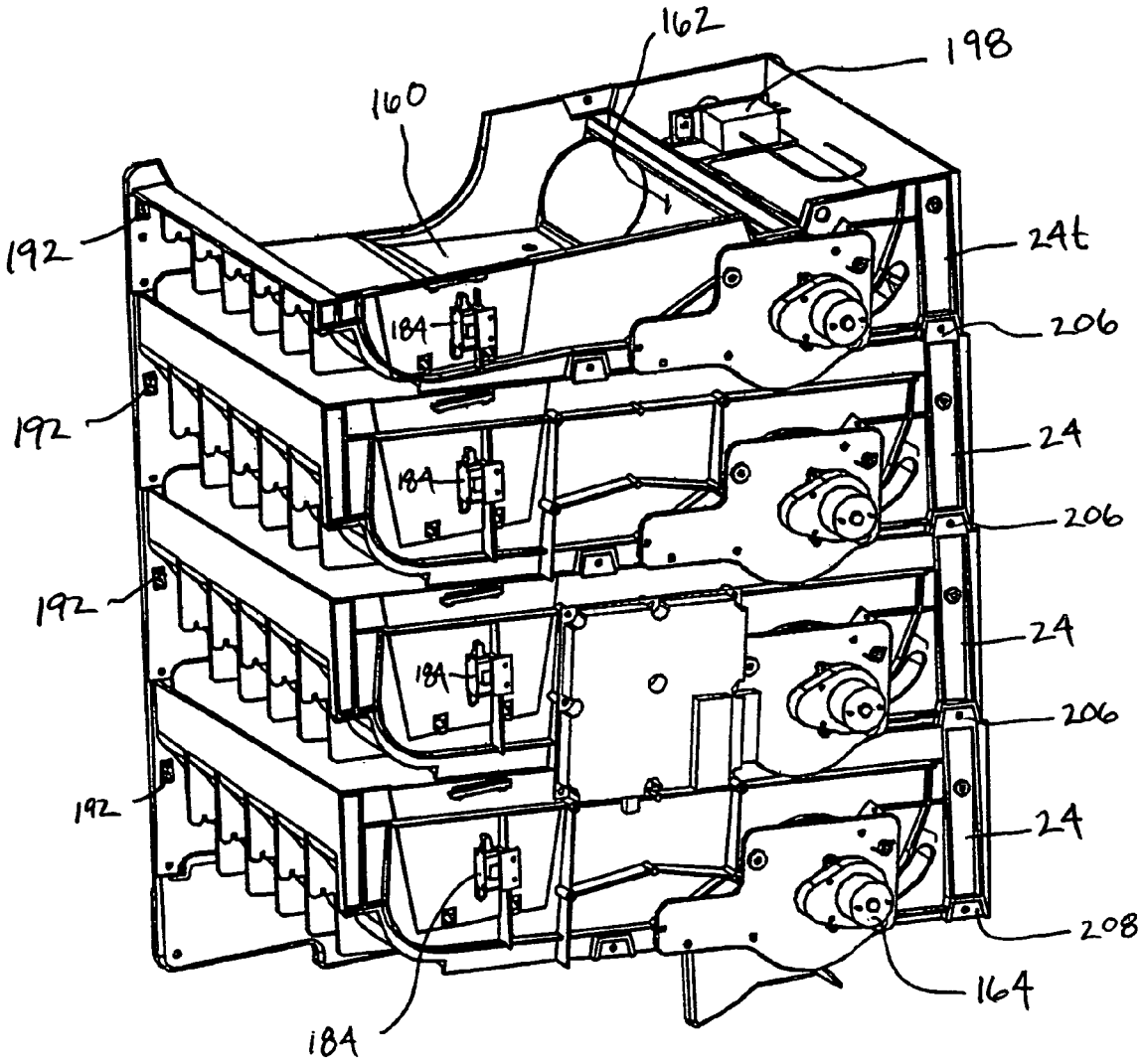
FIG. 12 is an isometric view generally from the rear of a stack of modular storage trays according to the present invention.

A mechanism is provided for indicating when the supply of cans 78 or bottles 76 within a particular bin 24 is getting low. As seen in FIGS. 11 and 12, at the rear of each storage bin 24 a low product activator 180 is provided. This low product activator 180 in the shown embodiment is a movable plate 182 that contacts a low product switch 184 mounted to the rear of the storage bin 24 (see FIG. 23). If there is no can 78 or bottle 76 against the movable plate 182, a signal is sent by the low product switch 184 to the corresponding indicator light 36 (see FIG. 1). Preferably the signal is electrical and the necessary wiring (not shown) runs from the switch 184 to a controller 96 for the indicator lights 36. The movable plate 182 is preferably placed such that it will be activated when there are three rows of cans 78 or three bottles 76 in the storage bin 24, but will not be activated if there are just two rows of cans 78 or two bottles 76. The tilt of the bottom 160 of the storage bin 24 towards the rear wall 158, as best seen in FIG. 24, helps hold the cans 78 and bottles 76 against the movable plate 182. The placement of the low product activator 180 could be changed in order to receive a low indicator at different levels of remaining supply. For example the activator 180 could be moved closer to the dispensing mechanism 80 to sense when the supply is nearly depleted.

In this fashion the user will get an indicator when the supply in a particular bin 24 is getting low, not when it is completely empty. This will help the user restock before running out, and in time to allow the restocked cans 78 or bottles 76 to chill properly. Most vending machines provide an indicator light to indicate when the product is not available, so that a person will not put money into the machine to attempt to purchase a product that is not available. Typical vending machines only provide warning lights if the stock is completely empty so that users will not be confused as to whether a product is available for purchase or not. However, this is not a significant concern for an in-home or office dispenser as contemplated by the present invention.

The electrical components that help control the dispensing process according to one embodiment of the invention are shown in the schematic of FIG. 28. A main control unit 96 is provided in the cabinet 14, preferably, but not critically, in the rear behind the storage bins 24. The main control unit 96 can be a printed circuit board with embedded software. A front panel processor 186, which also may be a printed circuit board with embedded software, is provided in the door 22. The main controller 96 and the front panel processor 186 communicate with each other. In the embodiment shown, they communicate by through an asynchronous serial interface provided through the wire harness 94. It may be possible to use RF or even IR communication in different embodiments. The front panel processor 186 monitors and controls the electrical components in the door 22, including the indicator lights 36, selection buttons 18, a dispensing area light 188, and a switch 190 on the dispensing area door 110 that senses when the dispensing area door 110 is open. The main controller 96 is attached to the electrical components in the cabinet 14 including each motor 164, a disable switch 192 attached to each motor 164, the low product switches 184, the chute switches 172, home switches 194 for sensing the position of the dispensing cups 162, and main door switch 196 that senses when the door 22 is opened.

The front panel processor 186 reports the status of the selection button switches 202, the switch 190 on the dispensing area door 110, the indicator lights 36, and the dispensing area light 188 to the main control unit 96. If the front panel processor 186 does not receive valid data from the main control unit 96, the front panel processor 186 will cause the indicator lights 36 to continuously flash, to give the user notification of a problem. Similarly, if the main control unit 96 does not receive proper data from the front panel processor 186, all motors 164 will remain deactivated. This deactivated condition will remain until the door 22 is opened and the main control unit 96 receives a signal from the main door switch 196 that the door 22 has been opened and closed.

When a selection button 18 is pressed, the corresponding selection button switch 202 is activated sending a signal to the front panel processor 186, which in turn sends a signal to the main control unit 96. If no errors are sensed by the main control unit 96 (e.g., main door 22 open or the like), the main control unit 96 will turn on the motor 164 corresponding to the pressed selection button 18. The motor 164 will turn the dispensing cup 162 at a rate of about fifteen revolutions per minute (i.e., four seconds per revolution). The dispensing cup 162 will continue to rotate until a can 78 or bottle 76 is dispensed to trigger the chute switch 172. After the chute switch 172 is triggered, the main control unit 96 will stop the motor 164 immediately, or after a short specified period of time. The can 78 or bottle 76 will continue to fall down the dispensing path 102 until it opens door 110, thereby opening the switch 190 on the dispensing area door 110. When the dispensing area door switch 190 is opened, the system turns on the dispensing area light 188, and ensures that all of the motors 164 are off. When the dispensing area door 110 closes, after the can 78 or bottle 76 clears the door 110, the main control unit 96 receives a signal from switch 190, and then permits the motors 164 to run again (if necessary). The dispensing area light 188 remains illuminated for a set period of time—typically about ten seconds—after the dispensing area door switch 190 is closed.

As noted above, the dispensing area door switch 190 senses when the dispensing area door 110 has been opened and closed. After one of the chute switches 172 senses that a can 78 or bottle 76 has been dropped out of a dispensing cup 162, the main control unit 96 prevents the motors 164 from dispensing additional bottles 76 or cans 78 until switch 190 senses that dispensing area door 110 has been opened and closed. In this fashion, the system prevent dispensing multiple cans 78 or bottles 78 at the same time, which can cause jamming of the dispensing path 102 and breaking of glass bottles.

The dispensing area door switch 190 is also used to activate a light 188 that illuminates the dispensing area 28 when a can 78 or bottle 76 is dispensed. As soon as the dispensing door switch 190 senses that the dispensing door 110 has been opened, it will illuminate light 188, which may be a light emitted diode (LED) located in or near the dispensing area 28. In this fashion the user will get notification that a bottle 76 or can 78 has been vended, and if it is dark, may be able to better see the bottle 76 or can 78 to grab it. Preferably the LED 188 will remain lit until a specified period of time after the dispensing door 110 has closed. For example, the closing of the dispensing door 110 can be a signal to turn off the LED 188 after ten seconds. Therefore, the opening and closing of the dispensing door 110 is used as a simple and reliable trigger for turning on and off the vending area light 188.

As best seen in FIG. 12, each storage bin 24 is provided with a disable switch 192. Each disable switch 192 is a toggle switch that can be moved by hand between a lock-out position and an allow dispense position. When the main control unit 96 senses that a disable switch 192 is in a lock-out position, the main control unit 96 will not permit the motor 164 associated with the storage bin 24 of that disable switch to be activated. If the main control unit 96 senses that the disable switch 192 is in an allow dispense position, it will permit the motor 164 associated with that disable switch 192 to run, if other necessary conditions are met. Therefore, individual storage bins 24 can be selectively disabled so that they will not dispense. Combined with the lock 84 on the door 22, this provides an effective way for parents to prevent children from dispensing alcoholic beverages when the dispenser 10 is unattended. Because the disable switch 192 is provided on the interior of the cabinet 14, preferably on the bin 24 with which it is associated, the door 22 must be opened to move the disable switch 192 from the lock-out position to the allow dispense position. By moving the disable switch 192 on a storage bin to the lock-out position, and then using a key to lock the door 22, a user can prevent access to beverages in a specified bin 24. Some or all of the bins 24 can be disabled in this fashion. To reactivate a bin 24, all that is needed is to unlock and open the door 22, and adjust the toggle switch 192 to the allow dispense position.

As cans 78 or bottles 76 proceed through the dispense path 102 to the dispensing area 28 they can become shaken or jarred. This is especially true at the bottom of the vend path when the bottle 78 or can 76 come to a quick stop. The problem is exacerbated if the can or bottle has fallen from the top dispensing cup 162 of the top storage bin 24*t*. Highly carbonated beverages can foam or spew excessively if they are jarred or shaken immediately before opening. For this reason it is advisable to place highly carbonated beverages in the lower storage bins, and to wait a few seconds after dispensing before opening.

The present invention also includes structure that overcomes some of the aforementioned spewing problem by making the trip through the dispensing path 102 more gentle. FIG. 11 illustrates this structure that helps reduce the foaming problem. A friction material 122, preferably in the form of fabric netting or webbing is provided along the left wall 106 of the dispenser 10 adjacent to and interfering with the dispensing path 102. Biased flaps 120 also extend from the storage bins 24 into the dispensing path 102. As a bottle 76 or can 78 falls through the dispensing path 102, the biased flaps 120 slow the rate at which the can 78 or bottle 76 falls, and tend to force the can 78 or bottle 76 towards the friction material 122 provided along the wall 106. The combination of the slowing effect of the biased flaps 120 and the friction provided by the friction material 122 reduces the speed at which the can 78 or bottle 76 falls through the dispensing path 102, which consequently reduces the jarring effect when the can 78 or bottle 76 is stopped in the dispensing area 28. Carbonated beverages are thus less likely to spew or foam excessively when opened. The friction material 122 can also be used to gently guide the can 78 or bottle 76 from the left side of the dispenser 10 to the center where the dispensing area 28 is preferably located. The friction material 122 can be any suitable flexible material that has sufficient friction that it will provide significant slowing of the can 78 or bottle 76, but not so much friction that is likely to cause grabbing or spinning of the item as it falls. A preferred friction material 122 is a vinyl coated polyester screen having a thickness of about 0.9 mm and a weight of about 13.5 ounces per square yard. The friction material 122 may be hung from any suitable location. According to the embodiment shown in FIG. 11 it is hung from the side wall 106 and slung around under the storage bins 24 and attached also under the storage bins 24. Padding 124 may also be provided in the dispensing area 28 to further reduce the jarring effect on the dispensed products. If no friction material is used, it is especially desirable to pad the chute 104 that leads to the dispensing area 28.

Although the present invention has been described with a certain degree of particularity, it is understood that the disclosure has been made by way of example, and changes in detail or structure may be made without departing from the spirit of the invention as defined in the appended claims.

What is claimed is:

1. A dispenser for dispensing beverage containers, the dispenser comprising:

a cabinet having the general appearance of a vending machine, but lacking any structure for monetary exchange, said cabinet including on its front a plurality of selection buttons for selecting a beverage container and a dispensing area for receiving a selected beverage container;

a plurality of vertically stacked storage bins within said cabinet for storing beverage containers; and a dispensing mechanism for moving said selected beverage containers from said storage bins to said dispensing area.

2. The dispenser according to claim 1, wherein said dispensing mechanism comprises a rotating cup.

3. The dispenser according to claim 1, wherein at least one of said storage bins comprises a bottom surface for supporting said beverage containers, and wherein said bottom surface is generally horizontal, but has a first incline toward a first end of said storage bin such that said beverage containers on said bottom surface are urged towards said first end; and wherein said dispensing mechanism is located proximate to said first end.

4. The dispenser according to claim 3, wherein said dispensing mechanism comprises a rotating cup.

5. The dispenser according to claim 1, wherein said beverage containers are bottles and cans, and wherein said dispensing mechanism will dispense both bottles and cans from any of said storage bins without adjustment to said storage bins or said dispensing mechanism.

6. A dispenser for dispensing beverage containers, the dispenser comprising:

a cabinet having the general appearance of a vending machine, but lacking any structure for monetary exchange, said cabinet including on its front a plurality of selection buttons for selecting a beverage container and a dispensing area for receiving a selected beverage container;

a plurality of vertically stacked storage bins within said cabinet for storing beverage containers; and a dispensing mechanism for moving said selected beverage containers from said storage bins to said dispensing area, wherein said dispensing mechanism is located at a first end of said vertically stacked storage bins; and wherein said dispensing mechanism moves said selected beverage container from one of said storage bins to a vertical dispensing pathway upon receiving a selection signal from one of said selection buttons, said selected beverage container falling down said vertical dispensing pathway to said dispensing area; and a slowing mechanism provided in said vertical dispensing pathway to slow said selected beverage container as it falls from said dispensing mechanism to said dispensing region.

7. The dispenser according to claim 6, wherein said slowing mechanism comprises a friction fabric.

8. The dispenser according to claim 7, wherein said friction fabric comprises a flexible webbing.

9. The dispenser according to claim 7, wherein said friction fabric comprises a vinyl coated polyester screen.

10. The dispenser according to claim 6, wherein said slowing mechanism comprises resiliently biased flaps extending into said vertical dispensing pathway.

11. A dispenser for dispensing bottles and cans, wherein said dispenser comprises:

a storage bin for storing bottles and cans prior to being dispensed;

a dispensing mechanism for selectively dispensing said bottles and cans in a horizontal orientation one at a time to a dispensing area; and wherein said storage bin and dispensing mechanism will dispense bottles and cans without the need to make adjustments to said dispensing mechanism or storage bin; wherein said storage bin has a bottom surface for supporting said bottles and cans, and wherein said bottom surface is generally horizontal, but has a first incline toward a first end of said storage bin such that said cans and bottles on said bottom surface are urged towards said first end; and wherein said dispensing mechanism comprises a rotating cup provided proximate to said first end of said storage bin.

12. The dispenser according to claim 11, wherein said rotating cup has the capacity to hold a single bottle or two cans.

13. The dispenser according to claim 11, wherein said dispensing mechanism comprises a barrier that retains a first can in said dispensing cup while a second can is dispensed to said dispensing area.

14. The dispenser according to claim 13, wherein said barrier is a wall proximate to said dispensing cup.

15. The dispenser according to claim 14, wherein said barrier is an extended portion of a trailing edge of said dispensing cup.

16. A dispenser for dispensing bottles and cans, the dispenser comprising:

an enclosed cabinet;

a plurality of storage bins within a refrigerated cabinet for storing bottles and cans, said plurality of storage bins including a bottom storage bin and at least one additional storage bin stacked sequentially on top of said bottom storage bin, wherein each of said storage bins is substantially identical with said other storage bins, and wherein each of said storage bins has a bottom surface on which said cans and bottles rest, and wherein said bottom surfaces are generally horizontal, but tilted sufficiently toward a first end of said storage bins that said cans and bottles are urged towards said first end;

a plurality of rotating cup dispensers, said plurality of rotating cup dispensers including a rotating cup dispenser associated with each storage bin at said first end of said storage bins; and a mechanism for selectively activating a desired rotating cup dispenser to dispense a single can or bottle from one of said storage bins.

* * * * *